US012137818B2

(12) United States Patent
Telford

(10) Patent No.: US 12,137,818 B2
(45) Date of Patent: Nov. 12, 2024

(54) ADJUSTABLE CHILD CARRIER WITH MULTIPLE CARRY ORIENTATIONS

(71) Applicant: The ERGO Baby Carrier, Inc., Torrance, CA (US)

(72) Inventor: Rodney V. Telford, Eagle Point, OR (US)

(73) Assignee: The ERGO Baby Carrier, Inc., Torrance, CA (US)

( * ) Notice: Subject to any disclaimer, the term of this patent is extended or adjusted under 35 U.S.C. 154(b) by 0 days.

(21) Appl. No.: 18/196,539

(22) Filed: May 12, 2023

(65) Prior Publication Data

US 2023/0276953 A1 Sep. 7, 2023

Related U.S. Application Data

(63) Continuation of application No. 17/689,554, filed on Mar. 8, 2022, now Pat. No. 11,684,175, which is a continuation of application No. 16/872,244, filed on May 11, 2020, now Pat. No. 11,297,957, which is a continuation of application No. 15/796,422, filed on Oct. 27, 2017, now Pat. No. 10,736,436.

(60) Provisional application No. 62/414,564, filed on Oct. 28, 2016.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/158–160
See application file for complete search history.

(56) References Cited

U.S. PATENT DOCUMENTS

| | | | |
|---|---|---|---|
| 268,932 | A | 12/1882 | Poirier |
| 569,258 | A | 10/1896 | Walker |
| 576,292 | A | 2/1897 | Vanderburgh |
| 632,887 | A | 9/1899 | Voncanon |
| 982,376 | A | 1/1911 | Macfarlane |
| 1,026,489 | A | 5/1912 | Blake |
| 2,212,746 | A | 8/1940 | Nunn |
| 2,599,474 | A | 6/1952 | Mills |
| 2,994,300 | A | 8/1961 | Josephine |

(Continued)

FOREIGN PATENT DOCUMENTS

| | | | |
|---|---|---|---|
| AU | 2003275751 | A1 | 6/2004 |
| AU | 317278 | S | 12/2007 |

(Continued)

OTHER PUBLICATIONS

Gilligan, Shannon, Best for Baby: A Selective Consumer's Guide to Products and Services from Infancy to Preschool, 1988, pp. 41-46.

(Continued)

*Primary Examiner* — Adam J Waggenspack
(74) *Attorney, Agent, or Firm* — Erise IP, P.A.

(57) ABSTRACT

An adjustable child carrier includes an adjustable bucket seat that can be adjusted to accommodate children of a wide range of sizes. The child carrier includes one or more adjustments that work alone or in cooperation to adjust the depth and width of the bucket seat area provided by the child carrier. The carrier is capable of supporting children of various sizes in an ergonomic position appropriate for the child's size. The child carrier is adjustable for multiple carrying positions and orientations.

20 Claims, 12 Drawing Sheets

(56) References Cited

U.S. PATENT DOCUMENTS 3,097,773 A 7/1963 Arthur
3,229,873 A 1/1966 Hershman
3,275,373 A 9/1966 Card
3,327,914 A 6/1967 Abram
3,481,517 A 12/1969 Aukerman
3,780,919 A 12/1973 Hansson
3,840,162 A 10/1974 Horenstein et al.
3,871,562 A 3/1975 Grenier
3,964,654 A 6/1976 Wittenberger
4,009,808 A 3/1977 Sharp
D247,199 S 2/1978 Carter
4,139,131 A 2/1979 Hathaway
4,149,687 A 4/1979 Nunemacher
D253,558 S 12/1979 Carter
4,234,229 A 11/1980 Arnold
4,273,215 A 6/1981 Leggett
4,318,502 A 3/1982 Lowe et al.
4,324,430 A 4/1982 Dimas et al.
4,333,591 A 6/1982 Case
D266,800 S 11/1982 Kula et al.
4,361,259 A 11/1982 Chanter
4,402,440 A 9/1983 Purtzer et al.
4,434,920 A 3/1984 Moore
4,467,945 A 8/1984 Schaapveld
4,469,259 A 9/1984 Krich et al.
4,479,595 A 10/1984 Opsal
D276,478 S 11/1984 Fallon
4,480,775 A 11/1984 Stanford
4,492,326 A 1/1985 Storm
D277,811 S 3/1985 Moore
4,550,800 A 11/1985 Dietrich
4,579,264 A 4/1986 Napolitano
4,651,366 A 3/1987 Lande et al.
4,666,017 A 5/1987 Zimmerman
4,724,988 A 2/1988 Tucker
4,746,044 A 5/1988 Arvizu et al.
4,765,279 A 8/1988 Klickstein
4,800,629 A 1/1989 Ikeda
4,867,464 A 9/1989 Cook
4,946,119 A 8/1990 Hellhake
4,986,458 A 1/1991 Linday
5,071,047 A 12/1991 Cordisco
5,076,598 A 12/1991 Nauman
D324,607 S 3/1992 Nelson
5,114,059 A 5/1992 Thatcher
5,129,406 A 7/1992 Magnusen et al.
D334,253 S 3/1993 Balzarini
5,205,450 A 4/1993 Derosier
5,205,451 A 4/1993 Manzer
5,224,637 A 7/1993 Colombo
5,240,159 A 8/1993 Gregory
5,246,152 A 9/1993 Dotseth
5,284,279 A 2/1994 Sason et al.
5,325,818 A 7/1994 Leach
D357,800 S 5/1995 Roan et al.
5,490,620 A 2/1996 Bergqvist
D370,996 S 6/1996 Shimura et al.
5,522,528 A 6/1996 Petricola
5,564,612 A 10/1996 Gregory
5,570,823 A 11/1996 Lindy
D377,116 S 1/1997 Shimura et al.
D385,105 S 10/1997 Fair
5,673,828 A 10/1997 Raedel et al.
5,678,739 A 10/1997 Darling et al.
5,690,258 A 11/1997 Kataoka
5,692,655 A 12/1997 Fair et al.
5,699,555 A 12/1997 Schunter
5,725,139 A 3/1998 Smith
5,732,861 A 3/1998 Jakobson
D395,161 S 6/1998 Fair et al.
5,772,088 A 6/1998 Nelson
5,791,535 A 8/1998 Roan et al.
D397,867 S 9/1998 Fair et al.
5,799,851 A 9/1998 Wulf et al.
5,813,580 A 9/1998 Fair
5,819,341 A 10/1998 Simantob et al.
5,848,576 A 12/1998 Colaianni
5,848,741 A 12/1998 Fair
5,927,235 A 7/1999 Olaiz
5,934,528 A 8/1999 Higuchi
D414,032 S 9/1999 Howell
5,988,742 A 11/1999 Stevens
6,055,686 A 5/2000 Knight
6,073,820 A 6/2000 Drobinski
6,079,780 A 6/2000 Bapst
6,125,792 A 10/2000 Gee
6,155,579 A 12/2000 Eyman et al.
6,164,509 A 12/2000 Gausling et al.
6,179,175 B1 1/2001 Painter
D437,996 S 2/2001 Fair et al.
6,182,873 B1 2/2001 Christopher et al.
6,257,468 B1 7/2001 Yamazoe et al.
6,325,259 B1 * 12/2001 Tharalson ..... A47D 13/029 224/159
D453,066 S 1/2002 Norman
D455,546 S 4/2002 Norman
6,364,186 B1 4/2002 Gilmour et al.
6,409,060 B2 6/2002 Donine
6,415,969 B1 7/2002 Higuchi
6,443,339 B1 9/2002 Higuchi
6,499,165 B1 12/2002 Morgillo
6,520,391 B2 2/2003 Yen
6,598,771 B2 7/2003 Norman
6,609,642 B2 8/2003 Heinz et al.
D484,685 S 1/2004 Kassai et al.
6,681,973 B2 1/2004 Crumrine
D486,635 S 2/2004 Yagisawa
6,715,651 B2 4/2004 Gal
6,722,543 B1 4/2004 Fitzgerald et al.
6,736,299 B2 5/2004 Bergkvist et al.
6,763,983 B2 7/2004 Norman
6,772,925 B2 8/2004 O'Hare
D507,869 S 8/2005 Liistro et al.
D509,056 S 9/2005 Shiraishi et al.
6,988,644 B1 * 1/2006 Asherbranner ..... A47D 13/025 224/160
7,007,353 B2 3/2006 Bergkvist et al.
7,070,076 B2 7/2006 Bergkvist et al.
7,073,866 B1 7/2006 Berdahl
7,168,600 B2 1/2007 Hwang
7,204,462 B2 4/2007 Lembo
7,204,468 B2 4/2007 Kintzele et al.
7,255,620 B1 8/2007 Shepherd et al.
7,284,503 B2 10/2007 Elmberg
7,322,498 B2 1/2008 Frost
7,343,880 B2 3/2008 Bergkvist
D567,499 S 4/2008 Elmberg et al.
7,494,031 B2 2/2009 Kassai et al.
D590,568 S 4/2009 Crutchfield
D597,788 S 8/2009 Ellis
D615,750 S 5/2010 Jones et al.
D619,818 S 7/2010 Bergkvist
7,766,199 B1 8/2010 Caperon
7,779,490 B2 8/2010 Bergkvist
7,780,236 B2 8/2010 Bergkvist
D623,401 S 9/2010 Bergkvist et al.
D623,402 S 9/2010 Bergkvist et al.
D627,141 S 11/2010 Elmberg
D632,887 S 2/2011 Jones et al.
7,878,587 B1 2/2011 Leach
7,886,946 B2 2/2011 Gray
D634,584 S 3/2011 Bergkvist
8,028,871 B2 10/2011 Gray
8,042,869 B2 10/2011 McClintock et al.
D647,693 S 11/2011 Olegård et al.
D649,345 S 11/2011 Bergkvist et al.
D653,938 S 2/2012 Bergkvist
D655,495 S 3/2012 Sauer et al.
8,127,385 B1 3/2012 Goutevenier
D656,749 S 4/2012 Bergkvist
8,172,116 B1 5/2012 Lehan et al.
D662,778 S 7/2012 Sauer et al.
D664,351 S 7/2012 Bergkvist et al.
8,272,546 B2 9/2012 Leistensnider

(56) References Cited

U.S. PATENT DOCUMENTS

D678,693 S 3/2013 Bergkvist et al.
8,403,189 B2 3/2013 Nyberg et al.
8,408,435 B2 4/2013 Refsum
8,424,732 B1 4/2013 Lehan et al.
D683,654 S 6/2013 Andren et al.
8,453,894 B2 6/2013 Jung et al.
D692,227 S 10/2013 Andren et al.
D692,680 S 11/2013 Bergkvist et al.
8,579,168 B2 11/2013 Zack et al.
8,590,757 B2 11/2013 Frost
8,627,988 B2 1/2014 Bergkvist
8,636,181 B2 1/2014 Gunter et al.
8,650,663 B2 2/2014 Fair et al.
8,701,949 B1 4/2014 Lehan et al.
8,726,437 B2 5/2014 Hardesty
8,745,794 B1 6/2014 McDermott
8,752,739 B2 6/2014 Bergkvist et al.
8,756,728 B2 6/2014 Bergkvist
8,789,882 B2 7/2014 Bergkvist
8,973,794 B2 3/2015 Bergkvist et al.
9,022,260 B2 5/2015 Frost
D733,419 S 7/2015 Wikner et al.
9,179,758 B2 * 11/2015 Calilung ..... A45F 3/08
9,185,993 B2 * 11/2015 Telford ..... A47D 13/025
9,220,352 B2 12/2015 Frost
9,314,113 B1 4/2016 Lehan
9,357,852 B2 6/2016 Salazar et al.
9,357,854 B2 6/2016 Sundberg et al.
9,380,887 B2 7/2016 Frost
9,380,888 B2 7/2016 Telford et al.
9,439,515 B2 9/2016 Kim
D773,838 S 12/2016 Ejvinsson et al.
D785,325 S 5/2017 Samrelius et al.
D786,363 S 5/2017 Andrén
D789,160 S 6/2017 Strandberg et al.
9,675,141 B2 6/2017 Wikner et al.
9,713,391 B2 7/2017 Telford et al.
9,788,664 B2 10/2017 Andren et al.
D803,549 S 11/2017 Warfaa et al.
D807,025 S 1/2018 Elmberg et al.
9,877,595 B2 1/2018 Wang
9,877,596 B2 1/2018 Schaarschmidt
D811,082 S 2/2018 Lehan
9,955,797 B2 5/2018 Telford et al.
D828,997 S 9/2018 Lehan
10,076,194 B2 9/2018 Wikner et al.
D832,602 S 11/2018 Elmberg et al.
10,159,357 B2 12/2018 Frost
10,172,478 B2 1/2019 Telford et al.
10,264,895 B2 4/2019 Lindeman et al.
10,271,663 B2 * 4/2019 Salazar ..... A47D 13/025
D850,804 S 6/2019 Andersson et al.
D851,916 S 6/2019 Andersson et al.
10,313,929 B2 6/2019 Bhamidipati et al.
10,426,275 B2 10/2019 Telford
10,433,656 B2 10/2019 Lundh
10,441,090 B2 10/2019 Lehan
10,506,885 B2 12/2019 Telford et al.
D879,413 S 3/2020 Ejvinsson et al.
D879,414 S 3/2020 Ejvinsson et al.
10,653,251 B1 5/2020 Young
D886,667 S 6/2020 Andersson et al.
D891,295 S 7/2020 Andersson et al.
10,702,074 B2 7/2020 Najafi et al.
10,736,436 B2 8/2020 Telford
10,743,678 B2 8/2020 Salazar et al.
D899,130 S 10/2020 Dolk et al.
10,874,178 B2 12/2020 Cheng
10,905,252 B2 2/2021 Fan
10,905,253 B2 2/2021 Fan
D913,683 S 3/2021 Björkenkvist et al.
11,026,519 B2 6/2021 Fan
11,026,520 B2 6/2021 Fan
11,026,521 B2 6/2021 Telford et al.
11,039,695 B2 6/2021 Fan
11,051,634 B2 7/2021 Telford
D930,976 S 9/2021 Andersson et al.
D933,356 S 10/2021 Elmberg
11,191,368 B2 12/2021 Manouchehri et al.
11,219,317 B2 1/2022 Telford
11,272,791 B2 3/2022 Warner
11,297,957 B2 4/2022 Telford
D954,156 S 6/2022 Hoxter et al.
D955,102 S 6/2022 Kleremo et al.
11,357,337 B2 6/2022 Dolk et al.
11,440,444 B2 9/2022 Shahbandar
D975,993 S 1/2023 Kleremo et al.
11,583,104 B2 2/2023 Telford
D980,623 S 3/2023 Kleremo et al.
D984,117 S 4/2023 Fan
11,684,175 B2 6/2023 Telford
11,759,027 B2 9/2023 Cheng
11,786,055 B2 10/2023 Telford
2002/0011503 A1 1/2002 Hwang
2002/0158433 A1 10/2002 Naurois et al.
2002/0175194 A1 11/2002 Norman
2003/0106916 A1 6/2003 Boone
2003/0178452 A1 9/2003 Norman
2004/0066066 A1 4/2004 Hobson
2004/0149790 A1 8/2004 Kassai et al.
2004/0155078 A1 8/2004 Hwang
2004/0238579 A1 12/2004 Krogh
2005/0045674 A1 3/2005 Rehbein
2005/0067549 A1 3/2005 Kintzele et al.
2005/0155995 A1 7/2005 Lee
2005/0184114 A1 8/2005 Hoff et al.
2005/0242136 A1 11/2005 Moriguchi et al.
2005/0279785 A1 12/2005 Liistro et al.
2006/0011678 A1 1/2006 Kassai et al.
2006/0076373 A1 4/2006 LaBelle et al.
2006/0130220 A1 6/2006 Morgan et al.
2006/0261104 A1 11/2006 Zambrzycki
2007/0029356 A1 2/2007 Moriguchi et al.
2007/0057003 A1 3/2007 Keyes
2007/0185370 A1 8/2007 Eyck
2007/0241146 A1 10/2007 Nyberg et al.
2007/0293656 A1 12/2007 Caravan et al.
2008/0047987 A1 2/2008 Price
2008/0283561 A1 11/2008 Parness et al.
2009/0165209 A1 7/2009 Bergkvist
2009/0256408 A1 10/2009 Bergkvisit
2010/0025441 A1 2/2010 Blaney
2010/0072236 A1 3/2010 Parness et al.
2010/0147910 A1 6/2010 Schachtner
2010/0187269 A1 7/2010 Leistensnider
2010/0308087 A1 12/2010 Lindbloom
2010/0308088 A1 12/2010 Lindblom
2011/0062195 A1 3/2011 Jones et al.
2011/0101051 A1 5/2011 Parness et al.
2011/0163136 A1 7/2011 Billingham
2011/0219539 A1 9/2011 Bergkvist
2011/0290831 A1 12/2011 Wang
2012/0025569 A1 2/2012 Bergkvist
2012/0037284 A1 2/2012 Korbonski
2012/0043359 A1 2/2012 Bergkvist et al.
2012/0061429 A1 3/2012 Sauer
2012/0187161 A1 7/2012 Bergkvist
2012/0187162 A1 7/2012 Bergkvist et al.
2012/0205406 A1 8/2012 Schachtner
2012/0241487 A1 9/2012 Zack et al.
2012/0298702 A1 11/2012 Jung et al.
2014/0014692 A1 1/2014 Andren et al.
2014/0097215 A1 4/2014 Caperon
2014/0167462 A1 6/2014 Lai et al.
2014/0263491 A1 9/2014 Telford et al.
2014/0284361 A1 9/2014 Wang
2014/0319189 A1 10/2014 Hoppener-Visser
2015/0181984 A1 7/2015 Wikner et al.
2015/0208821 A1 7/2015 Frost
2015/0223614 A1 8/2015 Pos
2015/0069097 A1 9/2015 Lindblom
2015/0272342 A1 10/2015 Schaarschmidt
2015/0374139 A1 12/2015 Salazar et al.
2016/0015187 A1 1/2016 Telford et al.

(56) References Cited

U.S. PATENT DOCUMENTS

| | | | |
|---|---|---|---|
| 2016/0150893 | A1 | 6/2016 | Salazar et al. |
| 2016/0227940 | A1 | 8/2016 | Wikner et al. |
| 2016/0270555 | A1 | 9/2016 | Telford et al. |
| 2016/0278537 | A1 | 9/2016 | Frost |
| 2016/0296034 | A1 | 10/2016 | Telford |
| 2016/0316933 | A1 | 11/2016 | Antunovic |
| 2017/0119173 | A1 | 5/2017 | Telford |
| 2017/0150826 | A1 | 6/2017 | Salazar et al. |
| 2017/0196374 | A1 | 7/2017 | Chen |
| 2017/0251829 | A1 | 9/2017 | Telford et al. |
| 2018/0000258 | A1 | 1/2018 | Lehan |
| 2018/0011642 | A1 | 1/2018 | Koseki et al. |
| 2018/0116426 | A1 | 5/2018 | Telford |
| 2018/0184813 | A1 | 7/2018 | Salazar et al. |
| 2018/0192788 | A1 | 7/2018 | Telford et al. |
| 2018/0199730 | A1 | 7/2018 | Lundh |
| 2018/0206653 | A1 | 7/2018 | Andrus et al. |
| 2018/0235379 | A1 | 8/2018 | Lindeman et al. |
| 2018/0296005 | A1 | 10/2018 | Tsai |
| 2019/0014920 | A1 | 1/2019 | Matsuyama |
| 2019/0075936 | A1 | 3/2019 | Salazar et al. |
| 2019/0090657 | A1 | 3/2019 | Telford et al. |
| 2019/0150633 | A1 | 5/2019 | Flaunty et al. |
| 2019/0223619 | A1 | 7/2019 | Lindeman et al. |
| 2019/0075937 | A1 | 10/2019 | Salazar et al. |
| 2019/0350379 | A1 | 11/2019 | Antunovic |
| 2019/0380508 | A1 | 12/2019 | Telford |
| 2020/0077806 | A1 | 3/2020 | Telford et al. |
| 2020/0146464 | A1 | 5/2020 | Manouchehri et al. |
| 2020/0163466 | A1 | 5/2020 | Telford |
| 2020/0253392 | A1 | 8/2020 | Sahadi et al. |
| 2020/0268169 | A1 | 8/2020 | Telford |
| 2021/0059431 | A1 | 3/2021 | Elmberg |
| 2021/0186234 | A1 | 6/2021 | Dolk et al. |
| 2021/0361079 | A1 | 11/2021 | Salazar et al. |
| 2021/0393049 | A1 | 12/2021 | Telford |
| 2022/0176853 | A1 | 6/2022 | Shahbandar |
| 2023/0248122 | A1 | 8/2023 | Cheng |

FOREIGN PATENT DOCUMENTS

| | | | |
|---|---|---|---|
| AU | 317280 | S | 12/2007 |
| AU | 331275 | S | 6/2010 |
| AU | 332115 | S | 8/2010 |
| AU | 345573 | S | 11/2012 |
| AU | 346297 | S | 1/2013 |
| AU | 2013287314 | A1 | 1/2015 |
| AU | 362724 | S | 7/2015 |
| AU | 363250 | S | 8/2015 |
| AU | 363251 | S | 8/2015 |
| AU | 367544 | S | 3/2016 |
| AU | 2015377212 | A1 | 8/2017 |
| AU | 201812916 | S | 6/2018 |
| AU | 201812917 | S | 6/2018 |
| AU | 201814272 | S | 8/2018 |
| AU | 201816523 | S | 11/2018 |
| AU | 201816866 | S | 1/2019 |
| AU | 2018385917 | A1 | 7/2020 |
| AU | 2019224931 | A1 | 9/2020 |
| CA | 1332928 | C | 11/1994 |
| CA | 2159241 | A1 | 3/1996 |
| CA | 2240015 | A1 | 1/2000 |
| CA | 132510 | S | 5/2010 |
| CA | 132511 | S | 5/2010 |
| CA | 148380 | S | 8/2013 |
| CA | 149046 | S | 11/2013 |
| CA | 154976 | A | 9/2014 |
| CA | 2739444 | C | 7/2015 |
| CA | 2971848 | A1 | 7/2016 |
| CA | 2755425 | C | 1/2017 |
| CA | 2822606 | C | 1/2018 |
| CA | 175255 | S | 4/2018 |
| CA | 179896 | S | 1/2019 |
| CA | 3091109 | A1 | 8/2019 |
| CA | 2822551 | C | 10/2019 |
| CA | D185008 | S | 11/2019 |
| CA | 2878911 | C | 3/2020 |
| CA | 2878933 | C | 8/2020 |
| CA | 181660 | S | 9/2020 |
| CA | 3160906 | A1 | 11/2022 |
| CN | 102378588 | A | 3/2012 |
| CN | 203873395 | U | 10/2014 |
| CN | 104411213 | A | 3/2015 |
| CN | 104470406 | A | 3/2015 |
| CN | 204363531 | U | 6/2015 |
| CN | 105377085 | A | 3/2016 |
| CN | 106263837 | A | 1/2017 |
| CN | 108135370 | A | 6/2018 |
| CN | 108244885 | A | 7/2018 |
| CN | 109480542 | A | 3/2019 |
| CN | 109480543 | A | 3/2019 |
| CN | 110897429 | A | 3/2020 |
| CN | 111712162 | A | 9/2020 |
| CN | 111885949 | A | 11/2020 |
| CN | 114668265 | A | 6/2022 |
| CN | 115399601 | A | 11/2022 |
| DE | 29519530 | U1 | 2/1996 |
| DE | 22912951 | U1 | 1/2000 |
| DE | 20116046 | U1 | 1/2002 |
| DE | 202008014412 | U1 | 3/2009 |
| DE | 602007005645 | | 5/2010 |
| DE | 602008000939 | | 5/2010 |
| DE | 202010011906 | U1 | 11/2010 |
| DE | 202011103052 | U1 | 8/2011 |
| DE | 10767394 | | 10/2012 |
| DE | 202012104318 | U1 | 11/2012 |
| DE | 202014100616 | U1 | 5/2014 |
| EP | 0046672 | A1 | 3/1982 |
| EP | 0437365 | A1 | 7/1991 |
| EP | 0662292 | A1 | 7/1995 |
| EP | 0662292 | B1 | 7/1998 |
| EP | 995380 | A1 | 4/2000 |
| EP | 1055382 | A1 | 11/2000 |
| EP | 1591044 | A1 | 11/2005 |
| EP | 1707082 | A1 | 10/2006 |
| EP | 1765123 | A2 | 3/2007 |
| EP | 1893058 | A1 | 3/2008 |
| EP | 1992257 | A1 | 11/2008 |
| EP | 2037777 | A1 | 3/2009 |
| EP | 2037778 | A1 | 3/2009 |
| EP | 2229079 | A1 | 9/2010 |
| EP | 1765123 | B1 | 6/2011 |
| EP | 2346378 | A1 | 7/2011 |
| EP | 2413747 | A1 | 2/2012 |
| EP | 2413748 | A1 | 2/2012 |
| EP | 2421413 | A1 | 2/2012 |
| EP | 2667747 | A1 | 12/2013 |
| EP | 2667748 | A1 | 12/2013 |
| EP | 2810587 | A1 | 12/2014 |
| EP | 2872011 | A1 | 5/2015 |
| EP | 2872012 | A1 | 5/2015 |
| EP | 3054813 | A1 | 8/2016 |
| EP | 3244778 | A1 | 11/2017 |
| EP | 3723556 | A1 | 10/2020 |
| EP | 3755183 | A1 | 12/2020 |
| EP | 4094639 | A1 | 11/2022 |
| ES | 251704 | U | 10/1980 |
| ES | 2343215 | | 7/2010 |
| ES | 2382645 | | 6/2012 |
| ES | 2437222 | | 1/2014 |
| ES | 2527676 | | 1/2015 |
| ES | 2531641 | | 3/2015 |
| ES | 2582469 | | 9/2016 |
| ES | 2585565 | | 10/2016 |
| ES | 2644318 | | 11/2017 |
| ES | 2823558 | | 5/2021 |
| ES | 2868448 | | 10/2021 |
| ES | 2889755 | | 1/2022 |
| FR | 1545820 | A | 11/1968 |
| FR | 2524288 | A1 | 10/1983 |
| FR | 2794010 | A1 | 12/2000 |
| FR | 2794010 | B1 | 7/2001 |
| FR | 2806279 | A3 | 9/2001 |
| FR | 2823655 | A1 | 10/2002 |

(56) References Cited

FOREIGN PATENT DOCUMENTS

| | | | |
|---|---|---|---|
| FR | 2851436 | A1 | 8/2004 |
| FR | 2823655 | B1 | 11/2004 |
| GB | 2028633 | A | 3/1980 |
| GB | 2026848 | B | 9/1982 |
| GB | 2260687 | A | 4/1993 |
| GB | 2314026 | B | 12/1999 |
| GB | 2346314 | A | 8/2000 |
| ID | 201800806 | A | 1/2018 |
| IL | 199975 | | 4/2010 |
| IL | 196219 | A | 8/2012 |
| JP | 11978146441 | A | 4/1953 |
| JP | 53146441 | | 12/1978 |
| JP | 53155443 | A | 12/1978 |
| JP | 54108131 | | 8/1979 |
| JP | 63187956 | | 12/1988 |
| JP | 1-72158 | A | 5/1989 |
| JP | 2124107 | | 5/1990 |
| JP | 09099842 | | 10/1995 |
| JP | 9121987 | | 5/1997 |
| JP | 09173185 | | 7/1997 |
| JP | 10108764 | | 4/1998 |
| JP | 10201580 | A | 8/1998 |
| JP | 10313929 | | 12/1998 |
| JP | 11046938 | | 2/1999 |
| JP | 3073766 | U | 12/2000 |
| JP | 2001104115 | A | 4/2001 |
| JP | 2002186543 | A | 7/2002 |
| JP | 3403599 | B2 | 5/2003 |
| JP | 2003225119 | A | 8/2003 |
| JP | 2004000687 | A | 1/2004 |
| JP | 2004154468 | A | 6/2004 |
| JP | 2005052584 | A | 3/2005 |
| JP | 2005118472 | A | 5/2005 |
| JP | 2005131146 | A | 5/2005 |
| JP | 2005185426 | A | 7/2005 |
| JP | 2005288107 | A | 10/2005 |
| JP | 2005312823 | A | 11/2005 |
| JP | 2005312826 | A | 11/2005 |
| JP | 4170894 | B2 | 10/2008 |
| JP | 3154408 | U | 10/2009 |
| JP | 2010524605 | A | 7/2010 |
| JP | 2012152547 | A | 8/2012 |
| JP | 2012152548 | A | 8/2012 |
| JP | 2012187352 | A | 10/2012 |
| JP | 2012524603 | A | 10/2012 |
| JP | 2013118900 | A | 6/2013 |
| JP | 2014018658 | A | 2/2014 |
| JP | 2014176494 | A | 9/2014 |
| JP | 5859841 | B2 | 2/2016 |
| JP | 5895766 | B2 | 3/2016 |
| JP | 2016512124 | A | 4/2016 |
| JP | 5921273 | B2 | 5/2016 |
| JP | 5960429 | B2 | 8/2016 |
| JP | 6130251 | B2 | 5/2017 |
| JP | 2018149349 | A | 9/2018 |
| JP | 2018531745 | A | 11/2018 |
| JP | 6485931 | B2 | 3/2019 |
| JP | 6530576 | B1 | 6/2019 |
| JP | 2019088891 | A | 6/2019 |
| KR | 2000508690000 | | 10/2000 |
| KR | 1020020008534 | A | 1/2002 |
| KR | 2003126950000 | | 4/2003 |
| KR | 2003158200000 | | 6/2003 |
| KR | 2003182590000 | | 6/2003 |
| KR | 2003201940000 | | 7/2003 |
| KR | 200324019 | Y1 | 8/2003 |
| KR | 2003337880000 | | 11/2003 |
| KR | 1020040064749 | A | 7/2004 |
| KR | 20060047603 | A | 5/2006 |
| KR | 1020070039806 | A | 4/2007 |
| KR | 2020090008715 | A | 1/2009 |
| KR | 200447518 | Y1 | 1/2010 |
| KR | 2020100010120 | A | 2/2010 |
| KR | 2020100010120 | U | 10/2010 |
| KR | 2020110005263 | A | 1/2011 |
| KR | 2020110005263 | U | 5/2011 |
| KR | 20110132580 | A | 12/2011 |
| KR | 101134560 | B1 | 4/2012 |
| KR | 200459659 | Y1 | 4/2012 |
| KR | 1020120070544 | A | 6/2012 |
| KR | 200462354 | Y1 | 9/2012 |
| KR | 101197918 | B1 | 11/2012 |
| KR | 1020130107167 | A | 10/2013 |
| KR | 101426751 | B1 | 8/2014 |
| KR | 20150030251 | A | 3/2015 |
| KR | 101525284 | B1 | 6/2015 |
| KR | 200477837 | Y1 | 7/2015 |
| KR | 1020160112243 | A | 9/2016 |
| KR | 20180031827 | A | 3/2018 |
| KR | 101929748 | B1 | 12/2018 |
| KR | 102022746 | B1 | 11/2019 |
| KR | 20200095511 | A | 8/2020 |
| KR | 20200123120 | A | 10/2020 |
| KR | 1020200119904 | A | 10/2020 |
| NO | 339506 | B1 | 12/2016 |
| NZ | 20150733728 | A | 7/2017 |
| PH | 12017501292 | A1 | 2/2018 |
| PH | 12022050229 | B | 4/2023 |
| SE | 0802427 | A1 | 5/2010 |
| SE | 533133 | C2 | 7/2010 |
| SE | 0900412 | A1 | 10/2010 |
| SE | 0900413 | A1 | 10/2010 |
| SE | 0900414 | A1 | 10/2010 |
| SE | 533613 | C2 | 11/2010 |
| SE | 533615 | C2 | 11/2010 |
| SE | 533616 | C2 | 11/2010 |
| SE | 0950955 | A1 | 6/2011 |
| SE | 534383 | C2 | 8/2011 |
| SE | 1150048 | A1 | 7/2012 |
| SE | 1150050 | A1 | 7/2012 |
| SE | 535533 | C2 | 9/2012 |
| SE | 535534 | C2 | 9/2012 |
| SE | 1250817 | A1 | 1/2014 |
| SE | 1250818 | A1 | 1/2014 |
| SE | 536591 | C2 | 3/2014 |
| SE | 536668 | C2 | 5/2014 |
| SE | 1351182 | A1 | 4/2015 |
| SE | 538604 | C2 | 9/2016 |
| SE | 1550298 | A1 | 9/2016 |
| SE | 1550352 | A1 | 9/2016 |
| SE | 538763 | C2 | 11/2016 |
| SE | 540206 | C2 | 5/2018 |
| SE | 1751550 | A1 | 6/2019 |
| SE | 1850189 | A1 | 8/2019 |
| SE | 541460 | C2 | 10/2019 |
| SE | 542422 | C2 | 4/2020 |
| SG | 127135 | A1 | 12/2006 |
| SG | 11201705794 | A | 8/2017 |
| TW | 200913922 | A | 4/2009 |
| TW | 201034603 | A | 10/2010 |
| TW | 201039779 | A | 11/2010 |
| TW | 201039781 | A | 11/2010 |
| TW | 201105273 | A | 2/2011 |
| TW | 201332466 | A | 8/2013 |
| TW | 202233104 | A | 9/2022 |
| WO | 199505952 | | 3/1995 |
| WO | 199505952 | A1 | 3/1995 |
| WO | 2001089978 | A1 | 11/2001 |
| WO | 2009034233 | A1 | 3/2009 |
| WO | 2010123447 | A1 | 10/2010 |
| WO | 2011011158 | A2 | 1/2011 |
| WO | 2011071441 | A1 | 6/2011 |
| WO | 2012079787 | A1 | 6/2012 |
| WO | 2012109467 | A1 | 8/2012 |
| WO | 2013079296 | A1 | 6/2013 |
| WO | 2014033134 | A1 | 3/2014 |
| WO | 2014160355 | A1 | 10/2014 |
| WO | 2015053696 | A1 | 4/2015 |
| WO | 20150053696 | A1 | 4/2015 |
| WO | 2016153411 | A1 | 9/2016 |
| WO | 2017075500 | A1 | 5/2017 |
| WO | 2017095752 | A1 | 6/2017 |
| WO | 2018081603 | A1 | 5/2018 |

(56) References Cited

FOREIGN PATENT DOCUMENTS

| | | | |
|---|---|---|---|
| WO | 2020112660 | A1 | 6/2020 |
| WO | 2020163585 | A1 | 8/2020 |
| WO | 2022136029 | A1 | 6/2022 |

OTHER PUBLICATIONS

Guide to the Ann Moore Innovative Lives Presentation, 1999, Archives Center, National Museum of American History, Smithsonian Institute, Aug. 2010, 12 pgs., retrieved from http://amhistory.si.edu/ archives/ AC0706.pdf).
Harman et al., "The Effects of Backpack Weight on the Biomechanics of Load Carriage," Military Division, U.S. Army Research Institute of Environmental Medicine, May 3, 2000, 72 pages.
Hinrichs, et al., "An Investigation of the Inertial Properties of Backpacks Loaded in Various Configurations", United States Army Natick, Research and Development Laboratories, Natick, MA, 1982, 75 pgs.
Hodgson, A.R., "Congenital Dislocation of the Hip", British Medical Journal, Sep. 7, 1961, p. 647.
Holewijn, Michael, "Physiological Strain Due to Load Carrying," European Journal of Applied Physiology and Occupational Physiology, Feb. 1990, 10 pgs.
http ://www.kelty.com/Kelty/index.cfm?fuseaction=Kids.ShowProduct &type=carrier&ID=l2, Aug. 5, 2002, 1 page.
http:/ /koti.welho.com/skoivune/english/guide/ohje3.html, May 1, 2003, 1 page.
http: /koti.welho.com/skoivune/sakara/english/about/index.html, Apr. 30, 2003, 2 pgs.
http: /koti.welho.com/skoivune/sakara/english/guide/index.html, Jun. 28, 2003, 1 page.
http: /koti.welho.com/skoivune/sakara/english/guide/ohje2.html, May 1, 2003, 1 page.
http: /koti.welho.com/skoivune/sakara/english/order/index.html, Apr. 30, 2003, 1 page.
http: /koti.welho.corn/skoivune/sakara/english/index html, Jun. 24, 2003, 2 pages.
http://koti.welho.com/skoivune/sakara/index2.html, Jun. 20, 2003, 2 pgs.
http://koti.welho.com/skoivune/sakara/index2.html, Jun. 20, 2003, 2 pages.
http://koti.welho.com/skoivune/sakara/ohje/ohje4.htrnl, May 2, 2003, 1 page.
http://koti.welho.com/skoivune/sakara/ohje/ohje6.html, May 29, 2003, 1 page.
http://koti.welho.com/skoivune/sakara/ohje/ohje7.html, May 9, 2003, 1 page.
http://koti.welho.com/skoivune/sakara/sakarat/index.html, Apr. 30, 2003, 2 pgs.
http://www.weego.com/acatalog/ool.html, Jun. 5, 2002, 3 pages.
http://www.weego.com/coinf.html, Aug. 6, 2002, 2 pages.
http://www.weego.com/fabric.htrnl, Nov. 2, 2001, 2 pages.
http://www.weego.com/preem.html, Aug. 6, 2002, 2 pages.
http://www.weego.com/product.html, Dec. 11, 2001, 1 page.
http://www.weego.de/ english/trageposition.htm, Apr. 23, 2004,1 page.
http://www.weego.de/024.htm, Aug. 12, 2003, 1 page.
http://www.weego.de/english/024.htm, Apr. 23, 2004, 1 page.
http://www.weego.de/english/design.htm, Mar. 24, 2004, 1 page.
http://www.weego.de/english/interaktiv.htm, Jul. 3, 2004, 1 page.
http://www.weego.de/english/ortho.htm, Jun. 1, 2004, 1 page.
Initial Determination on Violation of Section 337 and Recommended Determination on Remedy and Bond, In re Matter of Certain Child Carriers, United States International Trade Commission, Inv. No. 337-TA-1154, Mar. 10, 2020, 210 pgs.
International Preliminary Report on Patentability (Ch. 1) for International Application No. PCT/US2019/063052, dated May 25, 2021, 4 pgs.
International Preliminary Report on Patentability (Ch. I) for International Patent Application No. PCT/US2014/026378, dated Sep. 15, 2015, 6 pgs.
International Preliminary Report on Patentability (IPRP) issued for International Application No. PCT/US2017/058820, dated May 9, 2019, 11 pages.
International Preliminary Report on Patentability and Written Opinion for PCT/US2016/59534, dated May 1, 2018, 6 pgs.
International Preliminary Report on Patentability for PCT /US2004/029614, dated Mar. 13, 2006, 7 pgs.
International Search Report and Written Opinion for International Application No. PCT/US2014/026378, dated Jul. 21, 2014, 10 pgs.
Office Action for U.S. Appl. No. 14/685,235, dated May 22, 2015, 8 pgs.
International Search Report and Written Opinion for International Patent Application No. PCT/US17/58820, dated Jan. 5, 2018, 12 pgs.
International Search Report and Written Opinion for International Patent Application No. PCT/US19/063052, 11 pgs.
International Search Report and Written Opinion for International Patent Application No. PCT/US2016/026626, dated Jun. 30, 2016, 7 pgs.
International Search Report and Written Opinion for International Patent Application No. PCT/US2016/059534, dated Jan. 3, 2017, 8 pgs.
International Search Report and Written Opinion for PCT Application No. PCT /US2004/029614, completed on Feb. 11, 2005, dated Mar. 3, 2005, 9 pgs.
Joint Motion to Terminate for Inter Partes Review of U.S. Pat. No. 9,022,260 (IPR2016-01870) and U.S. Pat. No. 8,590,757 (IPR2016-01866), 3 pgs.
Jones et al., "Guide to Baby Products," Consumer Reports Books, Fourth Edition, Dec. 1995, 10 pages.
Jones, S., "Guide to Baby Products," Consumer Reports, Completely Revised Seventh Edition, 2001, 21 pages.
Jones, Sandy, Back Packs and Soft Carriers, Guide to Baby Products, Consumers Digest, 1998, Ch. 4, pp. 33-40.
Jones, Sandy, Back Packs and Soft Carriers, Guide to Baby Products, Consumers Reports, 1991, pp. 9-15.
Jones, Sandy, Getting Around, Guide to Baby Products, Consumers Digest, 2001, pp. 41, 55-60, 157-160, 199-201.
King, F.H, "Farmers of Forty Centuries," Copyright 2002 Blackmask Online, www.blackmask.com, 118 pages.
Kirkilionis, E., Das Tragen des Siiuglings im Hiiftsitz—eine spezielle Anpassung des menschlichen Traglings. Zoologische Jahrbiicher, 1992, 96 (3), 395-415.
U.S. Appl. No. 18/136,979, filed Apr. 20, 2023, Rodney V. Telford.
U.S. Appl. No. 18/196,539, filed May 12, 2023, Rodney V. Telford.
U.S. Appl. No. 18/202,058, filed May 25, 2023, Rodney V. Telford.
U.S. Appl. No. 18/206,922, filed Jun. 7, 2023, Daruni M. Gotel.
"Baby Trekker Instruction Manual," 16 pgs.
"The Beginning" Ergo Baby Blog, 7 pgs., retrieved from https:// blog.ergobaby.com/2011/02/the-beginning/).
Notice of Allowance with English translation for Korean Patent Application No. 10-2020-7029046, dated Aug. 5, 2021, 8 pgs.
U.S. Appl. No. 18/202,058, Non-Final Office Action dated Aug. 14, 2023.
U.S. Appl. No. 17/572,084, Final Office Action dated Jul. 10, 2023.
Apprica, Baby strap "Laclis Laclis", Baby Products Apprica Official Website Sep. 2023, https:// www.aprica.jp/products/sling/detail/sling/laclis/, Japan.
Certified Translation of "What parents should watch out for when buying babywearing carriers" by Kirkiliones, retrieved from http:// web.archive.org/web/200107190331 13/http://www.continuum-concept.de/liedkir.htm).
Chinese Patent Application No. 201780075232.5, Office Action dated May 10, 2022.
Corrected Notice of Allowability for U.S. Appl. No. 15/796,422, dated May 30, 2019, 6 pgs.
European Patent Application 16860977.4 Office Action issued Mar. 22, 2023.
European Patent Application 21180405.9 Decision to Grant issued May 11, 2023.

(56) References Cited

OTHER PUBLICATIONS

Examination Report issued for European Patent Application No. 17864576.8, dated Nov. 16, 2020, 5 pgs.
Office Action Issued for U.S. Appl. No. 15/177,114, dated Oct. 3, 2017, 5 pages.
Office Action Issued for Japanese Patent Application No. 2016-502118, dated Apr. 7, 2017, 9 pages.
Office Action issued for Chinese Patent Application No. 201480023993.2, dated Sep. 26, 2017, 5 pages.
Office Action for U.S. Appl. No. 11/949,324, dated Oct. 6, 2009, 9 pgs.
Infantino, Flip 4-in-1 Convertible Carrier Instruction Manual, 2018, www.info@Blue-box.com.
Infantino, Flip 4-in-1 Convertible Carrier Instruction Manual, 2022, www.infantino.com.
NUNA International B.V., Cudl Clik Instructions User Manual, www.nunababy.com.
International Search Report and Written Opinion, International Patent Application No. PCT/US2017/058820, dated Jan. 5, 2018, 11 pgs.
Lascal M1 Carrier User Manual, ASTM F2236-16a, EN13209-2:2015, US-80006 Ver13, www.lascal.net.
Lucky Industries Co., Ltd., Lucky 1934 Lucky Fuwa Hug, Waist Belt Type, https://lucky-industries.jp/products/lucky1934-fuwa-hug/, Japan.
Lucky Industries Co., Ltd., Lucky1934 (Lucky 1934) fuwahug Fuwahug Baby Carrier Baby Strap L4620 (from 14 days old), https:// luckybabystore.jp/products/fuwahug 2023, Japan.
Meet Isara Quick Half Buckle Carrier, https:// www.yumpu.com/en/document/read/63362302/isara-quick-half-buckle-carrier.
Najell Rise, Baby Carrier I 0-3 years I 3 Carrying Position, https://najell.com/p/najell-rise-jet-black.
Notice of Allowance issued for U.S. Appl. No. 15/602,744, dated Dec. 8, 2017, 14 pages.
Notice of Allowance for Korean Patent Application No. KR 10-2015-7028949, dated Dec. 13, 2017, 5 pages.
Notice of Allowance for U.S. Appl. No. 15/337,813, dated Jul. 1, 2019, 21 pgs.
Notice of Allowance for U.S. Appl. No. 15/796,422, dated Apr. 20, 2020, 4 pgs.
Notice of Allowance for U.S. Appl. No. 15/796,422, dated Mar. 27, 2019, 53 pgs.
Notice of Allowance for U.S. Appl. No. 15/916,990, dated Aug. 15, 2018, 15 pgs.
Notice of Allowance for U.S. Appl. No. 15/916,990, dated Nov. 9, 2018, 44 pgs.
Notice of Allowance for U.S. Appl. No. 16/694,641, dated Sep. 7, 2021, 23 pgs.
Notice of Allowance issued for U.S. Appl. No. 15/170,629, dated Feb. 1, 2017, 14 pages.
Notice of Allowance issued for U.S. Appl. No. 15/170,629, dated Oct. 28, 2016, 14 pages.
"Wearing Your Baby," http://wearingyourbaby.com.nz/history, 2014, 11 pages.
Notice of Allowance for Chinese Patent Application No. CN-201480023993.2, dated Mar. 5, 2018, 7 pages.
Office Action for U.S. Appl. No. 14/685,235, dated Nov. 27, 2015, 8 pgs.
Office Action for U.S. Appl. No. 14/862,933, dated Oct. 30, 2015, 5 pgs.
Office Action for U.S. Appl. No. 15/094,515, dated Feb. 19, 2019, 15 pgs.
Office Action for U.S. Appl. No. 15/094,515, dated Jun. 28, 2018, 15 pgs.
Office Action for U.S. Appl. No. 15/177,114, dated Aug. 24, 2016, 10 pgs.
Office Action for U.S. Appl. No. 15/177,114, dated Feb. 21, 2018, 13 pages.
Office Action for U.S. Appl. No. 15/177,114, dated May 30, 2018, 5 pgs.
Office Action for U.S. Appl. No. 15/177,114, dated May 31, 2017, 12 pages.
Office Action for U.S. Appl. No. 15/177,114, dated Nov. 3, 2017, 12 pages.
Office Action for U.S. Appl. No. 15/177,114, dated Oct. 3, 2017, 5 pages.
Office Action for U.S. Appl. No. 15/337,813, dated May 22, 2018, 6 pgs.
Office Action for U.S. Appl. No. 15/602,744, dated Aug. 8, 2017, 42 pages.
Office Action for U.S. Appl. No. 15/796,422, dated Nov. 21, 2019, 20 pgs.
Office Action for U.S. Appl. No. 15/796,422, dated Nov. 26, 2018, 18 pgs.
Office Action for U.S. Appl. No. 15/916,990, dated May 15, 2018, 5 pgs.
Office Action for U.S. Appl. No. 16/204,581, dated Jan. 25, 2019, 5 pgs.
Office Action for U.S. Appl. No. 16/551,286, dated Apr. 23, 2020, 6 pgs.
Office Action for U.S. Appl. No. 16/694,641, dated Mar. 17, 2021, 17 pgs.
Office Action Issued for Chinese Patent Application No. 201480023993.2, dated Jan. 11, 2017, 20 pages.
Office Action with English translation for Chinese Patent Application No. 201680071536.X, dated Apr. 7, 2021, 18 pgs.
Office Action with English translation for Japanese Patent Application No. 2018-521974, dated Oct. 24, 2019, 7 pgs.
Office Action with English translation for Japanese Patent Application No. 2019-523098, dated May 31, 2021, 13 pgs.
Office Action with English translation for Korean Patent Application No. 10-2020-7029046, dated Jun. 2, 2021, 8 pgs.
Packababy, 17 pgs., retrieved from Web Archives of http://www.packababy.corn/.
Peekara Story, https://blog.naver.com/becocarrier/140212053895 >, 2022.
Pelot, R.P. et al., "A Static Biomechanical Load Carriage Model", RTO HFM Specialist Meeting on Soldier Mobility Innovation in Load Carriage System Design and Evaluation, Kingston, CA, Jun. 27-29, 2000, 13 pgs.
Pelot, Ron P., et al., "Background Document for an Advanced Personal Load Carriage System for the Canadian Forces", Ergonomics Research Group, Queen's University, Kingston, ON, CA, Mar. 29, 1995, 148 pgs.
Petition for Inter Partes Review of U.S. Pat. No. 8,590,757, 100 pgs.
Petition for Inter Partes Review of U.S. Pat. No. 9,022,260, 94 pgs.
Preliminary Invalidity Contentions, *The Ergo Baby Carrier, Inc.* v. *BOBA Inc.*, Case No. 2:15-cv-08946, in the United States District Court for the Central District of California, Jul. 15, 2016, 18 pgs.
Rafelman, Rachel, The Portable Baby, Baby Gear for the First Year, 1997, pp. 40-41.
REI-Kelty Kangaroo Child Carrier, 2 pgs., retrieved from https://web.archive.org/web/19970222133805/http://rei.com/shopping/store3/ CAMPING/BABY_CARRIERS/BABY_CARRIERS/bud/617589. html.
Respondent's Post-Hearing Initial Brief, In re Matter of Certain Child Carriers, United States International Trade Commission, Inv. No. 337-TA-1154, Jan. 6, 2020, 102 pgs.
Respondent's Post-Hearing Responsive Brief, In re Matter of Certain Child Carriers, United States International Trade Commission, Inv. No. 337-TA-1154, Jan. 28, 2020, 127 pgs.
Respondent's Pre-Hearing Brief, In re Matter of Certain Child Carriers, United States International Trade Commission, Inv. No. 337-TA-1154, Nov. 8, 2019, 405 pgs.
Rose, Marion, Baby Carriers—Cultural History, Aware Parenting, Dec. 8, 2006, 11 pgs., retrieved from http://awareparenting.blogspot.corn/2006/12/baby-carriers-cultural-history.html.
Rose, Marion, Baby Carriers—Cultural History, Aware Parenting, Dec. 8, 2006, 11 pgs., retrievedfromhttp://awareparenting.blogspot.com/2006/12/baby-carriers-cultural-history.html.
Roseman, E., et al., Baby Carriers, The Canadian Parents' Sourcebook, 1986, at pp. 149-153.

(56) References Cited

OTHER PUBLICATIONS

Salter, R.B., "Etiology, Pathogenesis and Possible Prevention of Congenital Dislocation of the Hip", The Canadian Medical Association Journal, vol. 98, No. 20, May 18, 1968.
Salter, R.B., "Etiology, Pathogenesis and Possible Prevention of Congential Dislocation of the Hip", The Canadian Medical Association Journal, vol. 98, No. 20, May 18, 1968.
Santa Cruz Sentinel, https://www.newspapers.com/image/71319712, Jul. 26, 1987, 1 page.
Santa Cruz Sentinel, https://www.newspapers.com/image/7139712, Jul. 26, 1987, 1 page.
SSC Instructions, <<http://www.isara.ro/en/content/7-instructiunissc», Copyright 2016 ISARA, 12 pgs.
SSC Instructions, http://www.isara.ro/en/content/7-instructiunissc, Copyright 2016 ISARA, 12 pages.
Tentative Ruling on Claim Construction, U.S. Pat. Nos. 8,590,757 and 9,022,260, *The Ergo Baby Carrier, Inc.* v. *BOBA Inc.*, Case No. 2: 15-cv-08946, in the United States District Court for the Central District of California, Dec. 1, 2016, 11 pgs.
The Age, Mar. 5, 1970 at p. 14. Certified Translation of "What parents should watch out for when buying babywearing carriers" by Kirkiliones, retrieved from http://web.archive.org/web/200107190331 13/http://www.continuum -concept.de/liedkir.htm).
Tough Traveler, Kidsystems, 3 pgs., retrieved from http://web.archive.org/web/20011106132550/http://www.toughtraveler.com/ cat7.html.
U.S. Appl. No. 60/501,396, filed Sep. 10, 2003, 9 pgs.
U.S. Trademark Serial No. 75057147 Documents, U.S. Patent and Trademark Office, 44 pgs.
Appendix CC: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix CCC: DIY Baby Sling System Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.
Appendix D: babyTrekker Instruction Manual copyright date stamped 1998 ("1998 babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 19 pgs.
Appendix DD: Kelty Kangaroo Invalidity Chart, *The Ergo Baby Carrier, Inc.* v. *BOBA Inc.*, Case No. 2: 15-cv-08946, In the United States District Court for the Central District of California, Jul. 15, 2016, 7 pgs.
Appendix DDD: Kozy System Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix E: babyTrekker Instruction Manual ("babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 21 pgs.
Appendix EE: Kirkiliones Invalidity Chart, *The Ergo Baby Carrier, Inc.* v. *BOBA Inc.*, Case No. 2: 15-cv-08946, In the United States District Court for the Central District of California, Jul. 15, 2016, 9 pgs.
Appendix EEE: Packababy System Invalidity Chart, *The Ergo Baby Carrier, Inc.* v. *BOBA Inc.*, Case No. 2: 15-cv-08946, In the United States District Court for the Central District of California, Jul. 15, 2016, 17 pgs.
Appendix F: babyTrekker System Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix FF: "Physicological, Biomechanical and Medical Aspects of Soldier Load Carriage" by Joseph Knapik, Presented in Jun. 2000 ("Knapik") Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.
Appendix FFF: Sakara System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix G: First Journey System Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix G: First Journey System Invalidity *The Ergo Baby Carrier, Inc.* v. *BOBA Inc.*, Case No. 2: 15-cv-08946, In the United States District Court for the Central District of California, Jul. 15, 2016, 21 pgs.
Appendix GG: U.S. Pat. No. 4,434,920 ("Moore") Invalidity Chart, *The Ergo Baby Carrier, Inc.* v. *BOBA Inc.*, Case No. 2: 15-cv-08946, In the United States District Court for the Central District of California, Jul. 15, 2016, 6 pgs.
Appendix GGG: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix H: French Patent Pub. No. 2795010 ("Ducruet") Invalidity Chart, *The Ergo Baby Carrier, Inc.* v. *BOBA Inc.*, Case No. 2: 15-cv-08946, In the United States District Court for the Central District of California, Jul. 15, 2016, 8 pgs.
Appendix HH: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2: 15-cv-08946, In the United States District Court for the Central District of California, Jul. 15, 2016, 13 pgs.
Appendix HHH: Casses Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix I: U.S. Pat. No. 4,986,458 ("Linday") Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix II: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix III: U.S. Pat. No. 6, 182,873 ("Christopher") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix J: U.S. Pat. No. 4,469,259 ("Krich") Invalidity Chart, *The Ergo Baby Carrier, Inc.* v. *BOBA Inc.*, Case No. 2: 15-cv-08946, In the United States District Court for the Central District of California, Jul. 15, 2016, 8 pgs.
Appendix JJ: U.S. Pat. No. 5,114,059 ("Thatcher") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix JJJ: U.S. Pat. No. 6, 155,579 ("Eyman") Invalidity Chart, *The Ergo Baby Carrier, Inc.* v. *BOBA Inc.*, Case No. 2: 15-cv-08946, In the United States District Court for he Central District of California, Jul. 15, 2016, 2 pgs.
Appendix K: "A Blue-Jean Person Pack," by E.A. Byrnes as published on p. 164 of the May/Jun. 1982 issue of the Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix KK: Weego System Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix KKK: U.S. Pat. No. 5,848,741 ("Fair") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.

(56) References Cited

OTHER PUBLICATIONS

Appendix L: EP Patent No. 0437365 ("Gunderman") Invalidity Chart, *The Ergo Baby Carrier, Inc.* v. *BOBA Inc.*, Case No. 2: 15-cv-08946, In the United States District Court for the Central District of California, Jul. 15, 2016, 14 pgs.
Appendix LL: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix LLL: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix M: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix MM: Baby Matey Literature as Cited on the Face of U.S. Pat. No. 4,986,458 ("Baby Matey Literature") Invalidity Chart, *The Ergo Baby Carrier, Inc.* v. *BOBA Inc.*, Case No. 2: 15-cv-08946, In the United States District Court for the Central District of California, Jul. 15, 2016, 20 pgs.
Appendix MMM: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix N: Japanese Pub. No. S53-155443 ("The '443 Patent") Invalidity Chart, *The Ergo Baby Carrier, Inc.* v. *BOBA Inc.*, Case No. 2: 15-cv-08946, In the United States District Court for the Central District of California, Jul. 15, 2016, 12 pgs.
Appendix NN: Baby Matey System Invalidity Chart, *The Ergo Baby Carrier, Inc.* v. *BOBA Inc.*, Case No. 2: 15-cv-08946, In the United States District Court for the Central District of California, Jul. 15, 2016, 22 pgs.
Appendix NNN: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix O: Japanese Patent Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix OO: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OOO: Kelty Kangaroo Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix P: U.S. Pat. No. 4,009,808 ("Sharp") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix PP: babyTrekker Instruction Manual copyright date stamped 1998 ("1998 babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix PPP: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix Q: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix QQ: babyTrekker Instruction Manual ("babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 17 pgs.
Appendix QQQ: "Physiological, Biomechanical and Medical Aspects of Soldier Load Carriage" by Joseph Knapik, presented in Jun. 2000 ("Knapik") Invalidity Chart, *The Ergo Baby Carrier, Inc.* v. *BOBA Inc.*, Case No. 2: 15-cv-08946, In the United States District Court for the Central District of California, Jul. 15, 2016, 10 pgs.
Appendix R: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix RR: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix RRR: U.S. Pat. No. 4,434,920 ("Moore") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix S: Kozy System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SS: First Journey System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Exhibit RX-0341, In re Matter of Certain Child Carriers, United States International Trade Commission, Inv. No. 337-TA-1154, Infantino Flip 4-in-I Carrier Design Drawings, Sep. 21, 2017, 12 pgs.
Exhibit RX-0342, In re Matter of Certain Child Carriers, United States International Trade Commission, Inv. No. 337-TA-1154, Infantino Flip 4-in-I Carrier Product Manual, 2 pgs.
Exhibit RX-0343, In re Matter of Certain Child Carriers, United States International Trade Commission, Inv. No. 337-TA-1154, Infantino Upscale Carrier Product Manual, 2016, 10 pgs.
Exhibit RX-0344, In re Matter of Certain Child Carriers, United States International Trade Commission, Inv. No. 337-TA-1154, Infantino Upscale Carrier Product Manual RX, 2016, 10 pgs.
Exhibit RX-0347, In re Matter of Certain Child Carriers, United States International Trade Commission, Inv. No. 337-TA-1154, Infantino Go Forward Evolved Product Manual, 24 pgs.
Exhibit RX-0351, In re Matter of Certain Child Carriers, United States International Trade Commission, Inv. No. 337-TA-1154, Photograph of Michelle McEntire and Children, Feb. 17, 2008, 1 pg.
Exhibit RX-0402, In re Matter of Certain Child Carriers, United States International Trade Commission, Inv. No. 337-TA-1154, Web Archive Hibiscus Baby Wearing Instructions, 2007, 3 pgs.
Exhibit RX-0411, In re Matter of Certain Child Carriers, United States International Trade Commission, Inv. No. 337-TA-1154, The Cat Bird Baby Website Printout-Dur Booth at the ABC Kids Expo in Las Vegas, Sep. 13, 2007, 5 pgs.
Exhibit RX-0413, In re Matter of Certain Child Carriers, United States International Trade Commission, Inv. No. 337-TA-1154, The Cat Bird Baby Website Printout-Pikkolo, a Mei Tai-Like Buckle Carrier, Aug. 2, 2007, 5 pgs.
Exhibit RX-0415, In re Matter of Certain Child Carriers, United States International Trade Commission, Inv. No. 337-TA-1154, Pikkolo Carrier Design Drawings, Jul. 2007, 1 pg.
Exhibit RX-0417, In re Matter of Certain Child Carriers, United States International Trade Commission, Inv. No. 337-TA-1154, Cat Bird Baby Purchase Order, Sep. 25, 2007, 1 pg.
Exhibit RX-0419, In re Matter of Certain Child Carriers, United States International Trade Connnission, Inv. No. 337-TA-1154, Sales Receipt for Pikkolo Carrier, Sep. 14, 2007, 4 pgs.
Exhibit RX-0437, In re Matter of Certain Child Carriers, United States International Trade Commission, Inv. No. 337-TA-1154, FlickR Page Printout, Sep. 19, 2008, 2 pgs.

(56) References Cited

OTHER PUBLICATIONS

Exhibit RX-0480, In re Matter of Certain Child Carriers, United States International Trade Commission, Inv. No. 337-TA-1154, FlickR Photograph of Closet with Different Types of Material, Apr. 30, 2008, 3 pgs.
Exhibit RX-0482, In re Matter of Certain Child Carriers, United States International Trade Commission, Inv. No. 337-TA-1154, FlickR Photograph of Closet with Different Types of Material, Apr. 30, 2008, 2 pgs.
Exhibit RX-0484, In re Matter of Certain Child Carriers, United States International Trade Commission, Inv. No. 337-TA-1154, FlickR Photograph of crafting supplies, Apr. 30, 2008, 2 pgs.
Exhibit RX-0504, In re Matter of Certain Child Carriers, United States International Trade Commission, Inv. No. 337-TA-1154, Exhibit A to Declaration of Joline Sikora, Jul. 10, 2007, 1 pg.
Exhibit RX-0505, In re Matter of Certain Child Carriers, United States International Trade Commission, Inv. No. 337-TA-1154, Exhibit B to Declaration of Joline Sikora, Jul. 11, 2007, 3 pgs.
Exhibit RX-0506, In re Matter of Certain Child Carriers, United States International Trade Commission, Inv. No. 337-TA-1154, Exhibit C to Declaration of Joline Sikora, Jul. 11, 2007, 3 pgs.
Exhibit RX-0507, In re Matter of Certain Child Carriers, United States International Trade Commission, Inv. No. 337-TA-1154, Exhibit D to Declaration of Joline Sikora, Sep. 18, 2007, 1 pg.
Exhibit RX-0508, In re Matter of Certain Child Carriers, United States International Trade Commission, Inv. No. 337-TA-1154, Exhibit E to Declaration of Joline Sikora, Sep. 18, 2007, 1 pg.
Exhibit RX-0509, In re Matter of Certain Child Carriers, United States International Trade Commission, Inv. No. 337-TA-1154, Exhibit F to Declaration of Joline Sikora, Sep. 18, 2007, 1 pg.
Exhibit RX-0510, In re Matter of Certain Child Carriers, United States International Trade Commission, Inv. No. 337-TA-1154, Exhibit G to Declaration of Joline Sikora, Sep. 18, 2007, 1 pg.
Exhibit RX-0512, In re Matter of Certain Child Carriers, United States International Trade Commission, Inv. No. 337-TA-1154, Exhibit I to Declaration of Joline Sikora, 2007), 3 pgs.
Exhibit RX-0525, In re Matter of Certain Child Carriers, United States International Trade Commission, Inv. No. 337-TA-1154. Exhibit V to Declaration of Joline Sikora, Jul. 21, 2007-Sep. 19, 2008, 64 pgs.
Exhibit RX-0526, In re Matter of Certain Child Carriers, United States International Trade Commission, Inv. No. 337-TA-1154, Exhibit W to Declaration of Joline Sikora, Feb. 27, 2007-Apr. 5, 2009, 41 pgs.
Exhibit RX-0527, In re Matter of Certain Child Carriers, United States International Trade Commission, Inv. No. 337-TA-1154, Exhibit A to Declaration of Mischele McEntire, Feb. 17, 2007, 2 pgs.
Exhibit RX-0528, In re Matter of Certain Child Carriers, United States International Trade Commission, Inv. No. 337-TA-1154, Exhibit B to Declaration of Mischele McEntire, Feb. 17, 2008, 4 pgs.
Exhibit RX-0539, In re Matter of Certain Child Carriers, United States International Trade Commission, Inv. No. 337-TA-1154, LILLEbaby Complete 6 Position Baby Carrier User Manual, Exhibit 613 to Depo of L. Lehan, 16 pgs.
Exhibit RX-0551, In re Matter of Certain Child Carriers, United States International Trade Commission, Inv. No. 337-TA-1154, Silly Goose Photos and thread from babywearer.com, Sep. 14, 2007, 14 pgs.
Exhibit RX-0552, In re Matter of Certain Child Carriers, United States International Trade Commission, Inv. No. 337-TA-1154, Silly Goose Photos and thread from babywearer.com, Oct. 31, 2007, 15 pgs.
Extended European Search Report for European Patent Application No. 16860977.4, dated Jun. 5, 2019, 7 pgs.
Extended European Search Report for European Patent Application No. 17864576.8, dated Feb. 14, 2020, 7 pgs.
Feb. 2002 forum post from "USA", 2 pgs., retrieved from http://windsorpeak.corn/vbulletin/ showthread.php7 I 85 543-baby- bjornand-large-husband.
File History for European Patent Application No. 04783725.7, filed Sep. 10, 2004, 693 pages.
File History for U.S. Appl. No. 10/937,193, filed Sep. 9, 2004, 135 pages.
File History for U.S. Appl. No. 14/685,235, filed Apr. 13, 2015, 460 pages.
File History for U.S. Trademark Application No. 75457187, filed Mar. 25, 1998, 56 pages.
First Journey Brochure, www.first-journey.com, 2002, 2 pages.
Frame Carriers, 1 pg., retrieved from https://web.archive.org/web/200005 26184 53 5/http: /www.evenflo.corn/ep/furniture/framecarrier.phtrnl.
Gebrauchsanweisung (User's Manual), Weego Baby Carrier, 4 pages.
Gebrauchsanweisung (User's Manual), Weego Baby Carrier, 4 pgs.
"Why Choose the Wilkin et?," http://www.wilkinet.co.uk/WhyChoose.asp, Apr. 17, 2003, 2 pgs.
Warren, A.J., "The Mom Who Invented the Snugli", CBS News, Mar. 6, 2001, 4 pgs., retrieved from http://www.cbsnews.com/news/the-mom-who-invented-the- snugli/.
Wee go Soft Baby Carrier, Instructions for Use, Wee go Babytragesacke, Berlin, DE, 4 pgs.
Welcome to Sutemigear, 10 pgs., retrieved from Web Archives of http://sutemigear.com/.
Wilkin et—Product Views, http://www.wilkinet.co.uk/BabyCarriers.asp, Feb. 17, 2003, 2 pages.
Wilkinet—FAQ http://www.wilkinet.co.uk/FAQs.asp, Feb. 17, 2003, 3 pages.
Wilkinet—History of the Wilkinet Baby Carrier, http://www.wilkinet.co.uk/History.asp, Feb. 17, 2003, 3 pages.
Wilkinet—Instructional Videos, http://www.wilkinet.co.uk/Videos.asp, Feb. 18, 2003, 2 pages.
Wilkinet—Instructional Videos, www.wilkinet.co.uk/Videos.asp, Feb. 18, 2003, 2 pgs.
Wilkinet—Reviews and Testimonials, http://www.wilkinet.co.uk/ReviewsParents.asp, Feb. 18, 2003, 2 pages.
Wilkinet—Reviews and Testimonials, http://www.wilkinet.co.uk/ReviewsPress.asp, Feb. 18, 2003, 2 pages.
Wormleighton, A., "Baby Gifts: To Sew, Applique, Crochet and Knit," Copyright Marshall Cavendish Limited, 1998, 13 pages.
Wrapping instructions Baby Carriers, http://www.kokadi.de/en/instruction 162.html, Copyright 2016 IS ARA, 28 pages.
Appendix SSS: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.
Appendix T: Packababy System Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix TT: French Patent Pub. No. 2794010 ("Ducruet") Invalidity Chart,*The Ergo Baby Carrier, Inc.* v. *BOBA Inc.*, Case No. 2: 15-cv-08946, In the United States District Court for the Central District of California, Jul. 15, 2016, 5 pgs.
Appendix TTT: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix U: Sakara System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix U: Sakara System Invalidity Chart, *The Ergo Baby Carrier, Inc.* v. *BOBA Inc.*, Case No. 2:15-cv-08946, In the UnitedStates District Court of the Central District of California, Jul. 15, 2016, 18 pgs.
Appendix UU: U.S. Pat. No. 4,986,458 ("Linday") Invalidity Chart, *The Ergo Baby Carrier, Inc.* v. *BOBA Inc.*, Case No. 2: 15-cv-08946,

(56) References Cited

OTHER PUBLICATIONS

In the United States District Court for the Central District of California, Jul. 15, 2016, 15 pgs.
Appendix UUU: U.S. Pat. No. 5,114,059 ("Thatcher") Invalidity Chart, *The Ergo Baby Carrier, Inc.* v. *BOBA Inc.*, Case No. 2: 15-cv-08946, In the United States District Court for the Central District of California, Jul. 15, 2016, 3 pgs.
Appendix V: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix VV: U.S. Pat. No. 4,469,259 ("Krich") Invalidity Chart, *The Ergo Baby Carrier, Inc.* v. *BOBA Inc.*, Case No. 2: 15-cv-08946, In the United States District Court for the Central District of California, Jul. 15, 2016, 5 pgs.
Appendix VVV: Weego System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix W: Casses Invalidity Chart, *The Ergo Baby Carrier, Inc.* v. *BOBA Inc.*, Case No. 2: 15-cv-08946, In the United States District Court for the Central District of California, Jul. 15, 2016, 6 pgs.
Appendix WW: "A Blue-Jean Person Pack" by E.A. Byrnes as published on p. 164 of the May/Jun. 1982 issue of the Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix WWW: U.S. Pat. No. 6,257,468 ("Yamazoe") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix X: U.S. Pat. No. 6,182,873 ("Christopher") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix XX: EP Patent No. 0437365 ("Gunderman") Invalidity Chart, *The Ergo Baby Carrier, Inc.* v. *BOBA Inc.*, Case No. 2: 15-cv-08946, In the United States District Court for the Central District of California, Jul. 15, 2016, 14 pgs.
Appendix Y: U.S. Pat. No. 6,155,579 ("Eyman") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix YY: K wik Sew Pattern No. 1046 ("K wik Sew") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix Z: U.S. Pat. No. 5,848,741 ("Fair") Invalidity Chart,*The Ergo Baby Carrier, Inc.* v. *BOBA Inc.*, Case No. 2: 15-cv-08946, In the United States District Court for the Central District of California, Jul. 15, 2016, 4 pgs.
Appendix ZZ: Japanese Patent Publication No. S53-155443 ("The '443 Patent") Invalidity Chart, *The Ergo Baby Carrier, Inc.* v. *BOBA Inc.*, Case No. 2: 15-cv-08946, in the United States District Court for the Central District of California, Jul. 15, 2016, 10 pgs.
Aronson, D.D. et al., "Developmental dysplasia of the hip", Pediatrics, Aug. 1994, vol. 94(2), 202, 11 pgs.
Assorted Photos, U.S. Appl. No. 60/501,396, filed Sep. 10, 2003, 3 pages.
Assorted Photos, U.S. Appl. No. 63/501,396, filed Sep. 10, 2003, 3 pages.
Baby Matey Soft Baby Carriers Literature, Kidpower Unlimited Inc., Toronto, ON, CA, 10 pgs.
Baby Trekker—Advantages, 2 pgs., retrieved from https://web.archive.org/web/20000708 I 415II//http://www.babytrekker.com/advantages.htrn.
BabyTrekker Instruction Manual, Pettersen Infant Products, Canada, 16 pages.
BabyTrekker Instruction Manual, Pettersen Infant Products, Canada, 1998, 16 pages.
BabyTrekker Instruction Manual, Petterson Infant Products, Flin Flon, MB, CA, 1998, 16 pgs.
Bach, John, "Practical Inventor Influenced American Culture", University of Cincinnati UC Magazine, Aug. 2010, 6 pgs.
Blaffer Hardy, S., Family Planning Primate Style, Mother Nature—A History of Mothers, Infants and Natural Selection, 2000, pp. 197-204.
BOBA, Inc.'s First Amended Counterclaims for Declaration of Unenforceability, Invalidity, and Monopolization, *The Ergo Baby Carrier, Inc.* v. *BOBA Inc.*, Case No. 2:15-cv-08946, in the United States District Court for the Central District of California, May 23, 2016, 73 pgs.
Brewer, Gail S., A Quick Guide for Starting Right, Baby Carriers, Right from the Start: Meeting the Challenges of Mothering Your Unborn and Newborn Baby, 1981, pp. 159-160.
Byrnes, E.A., "A Blue-Jean 'Person Pack': Toting the Tot on the Trail", The Mother Earth News, No. 75, May/Jun. 1982, p. 164.
Casses, R., "Infant Carriers and Spinal Stress," http://continuumconcept.org/reading/spinalstress.html, Jun. 16, 2002, 3 pages.
Cessnock Eagle and South Mattland Recorder, vol. 32, No. 4162,Jun. 22, 1944, National library of Australia—http://nla.gov.au/ nla-news-pagel0625124, 1 page.
Chancellor, N., "It's a Shoulder Style," The Sydney Morning Herald, https://www.newspapers.com/image/123869066, Jun. 24, 1947, 1 page.
Coff, H., "Cut Scheduling for Optimum Fabric Utilization in Apparel Production," Georgia Institute of Technology, Nov. 1976, 141 pages.
Commission Investigative Staff's Initial Post-Hearing Brief, In re Matter of Certain Child Carriers, United States International Trade Commission, Inv. No. 337-TA-1154, Jan. 13, 2020, 124 pgs.
Commission Investigative Staff's Pre-Hearing Brief, In re Matter of Certain Child Carriers, United States International Trade Commission, Inv. No. 337-TA-1154, Nov. 20, 2019, 195 pgs.
Commission Investigative Staff's Reply Post-Hearing Brief, In re Matter of Certain Child Carriers, United States International Trade Commission, Inv. No. 337-TA-1154, Jan. 22, 2020, 26 pgs.
Complainant's Post-Hearing Initial Brief, In re Matter of Certain Child Carriers, United States International Trade Commission, Inv. No. 337-TA-1154, Jan. 6, 2020, 147 pgs.
Complainant's Post-Hearing Responsive Brief, In re Matter of Certain Child Carriers, United States International Trade Commission, Inv. No. 337-TA-1154, Jan. 17, 2020, 85 pgs.
Complainant's Pre-Hearing Brief, In re Matter of Certain Child Carriers, United States International Trade Commission, Inv. No. 337-TA-1154, Nov. 21, 2019, 852 pgs.
Complaint, *The Ergo Baby Carrier, Inc.* v. *BOBA Inc.*, Case No. 2:15-cv-08946, In the United States District Court for the Central District of California, filed Nov. 17, 2015, 7 pgs.
Constance, M., "Backpacking the Baby," The Sydney Morning Herald, https://www.newspapers.com/image/120542968, Dec. 1, 1988, 1 page.
Constance, S., "Backpacking the Baby," Sydney Morning Herald, Dec. 1, 1998, 3 pages.
Declaration of Judy Pettersen and Exhibits thereto, Aug. 14, 2016, 50 pgs.
Declaration of Judy Pettersen regarding BabyTrekker, May 26, 2011, 18 pgs.
Declaration of Judy Petterson regarding BabyTrekker with enclosures 1 and 2, dated May 26, 2011, 18 pgs.
Declaration of Richard N. Hinrichs, Ph.D and Appendix A thereto for Petition for Inter Partes Review of U.S. Pat. No. 9,022,260, 158 pgs.
Declaration of Richcard N. Hinrichs, Ph.D and Appendix A thereto for Petition for Inter Partes Review of U.S. Pat. No. 8,590,757, 155 pgs.
Declaration of Shari Hall White and Appendix A thereto, Jun. 29, 2016, 12 pgs.
Definition of "flexed", Random House Webster's Unabridged Dictionary, Oct. 1999, Second Edition, p. 733.
Doan, Marlyn, Children's Gear, Staffing Small in the Wilderness, The Sierra Club Outdoors Guide for Families, 1979, at pp. 161-167.

(56) References Cited

OTHER PUBLICATIONS

European Search Report for European Application No. 14773586.4, dated Oct. 16, 2016, 9 pgs.
European Search Report for European Patent Application No. 16777348.0, dated Oct. 4, 2018, 10 pgs.
Evenflo Soft Carriers, 2 pgs., retrieved from https://web.archive.org/web/20010331081113/http://www.evenflo.com/ep/furniture/softcarrier.phtml.
Examination Report for European Application No. 04 783 725.7, dated Dec. 21, 2009, 5 pgs.
Examination Report for European Application No. 04 783 725.7, dated Jun. 1, 2010, 6 pgs.
Examination Report for European Application No. 04 783 725.7, dated Sep. 10, 2009, 3 pgs.
Examination Report for European Application No. 04 783 725.7, dated Sep. 21, 2007, 3 pgs.
Examination Report for European Application No. 04 783 725.7, dated Sep. 9, 2008, 4 pgs.
Examination Report issued for European Patent Application No. FR 2 524 288 Oct. 1983 17864576.8, dated Nov. 16, 2020, 5 pgs.
Exhibit A to Declaration of Joline Sikora, Jul. 10, 2007, 1 pg.
Exhibit J to Declaration of Joline Sikora, 1 pg.
Exhibit K to Declaration of Joline Sikora, 2007, 1 pg.
Exhibit L to Declaration of Joline Sikora, Feb. 17, 2008, 4 pgs.
Exhibit Q to Declaration of Joline Sikora, Aug. 23, 2007, 2 pgs.
Exhibit R to Declaration of Joline Sikora, Aug. 23, 2007, 2 pgs.
Exhibit RX-0116, In re Matter of Certain Child Carriers, United States International Trade Commission, Inv. No. 337-TA-1154, Photographs Embedded in McKibbon Declaration, Exhibit 3 to Depo of McKibbon, 2 pgs.
Exhibit RX-0118, In re Matter of Certain Child Carriers, United States International Trade Commission, Inv. No. 337-TA-1154, Photographs Embedded in McKibbon Declaration, Exhibit 4 to Depo of McKibbon, 1 pg.
Exhibit RX-0120, In re Matter of Certain Child Carriers, United States International Trade Commission, Inv. No. 337-TA-1154, Flickr Photos of Petals and Puddles, Exhibit 5 to Depo of McKibbon, 3 pgs.
Exhibit RX-0123, In re Matter of Certain Child Carriers, United States International Trade Commission, Inv. No. 337-TA-1154: Photo of carrier, Exhibit 7 to Depo of McKibbon, 1 pg.
Exhibit RX-0133, In re Matter of Certain Child Carriers, United States International Trade Commission, Inv. No. 337-TA-1154, Etsy Pages for petalsandpuddles, Exhibit 82 to Depo of Wick, 4 pgs.
Exhibit RX-0135, In re Matter of Certain Child Carriers, United States International Trade Commission, Inv. No. 337-TA-1154, Wayback Machine Page for Etsy search results baby sling, Exhibit 83 to Depo of Wick, Aug. 19, 2010, 4 pgs.
Exhibit RX-0135, In re Matter of Certain Child Carriers, United States International Trade Connnission, Inv. No. 337-TA-1154, Wayback Machine Page for Etsy search results baby sling, Exhibit 83 to Depo of Wick, Aug. 19, 2010, 4 pgs.
Exhibit RX-0159, In re Matter of Certain Child Carriers, United States International Trade Commission, Inv. No. 337-TA-1154, Ergobaby Omni 360 Cool Air Mesh Instruction Manual, 26 pgs.
Exhibit RX-0159, In re Matter of Certain Child Carriers, United States International Trade Connnission, Inv. No. 337-TA-1154, Ergobaby Omni 360 Cool Air Mesh Instruction Manual, 26 pgs.
Exhibit RX-0160, In re Matter of Certain Child Carriers, United States International Trade Commission, Inv. No. 337-TA-1154, Ergobaby Omni 360 Instruction Manual, 26 pgs.
Exhibit RX-0161, In re Matter of Certain Child Carriers, United States International Trade Commission, Inv. No. 337-TA-1154, Ergobaby Adapt Instruction Manual, 23 pgs.
Exhibit RX-0163, In re Matter of Certain Child Carriers, United States International Trade Commission, Inv. No. 337-TA-1154, Ergobaby 360 Bundle of Joy Instruction Manual, 26 pgs.
Exhibit RX-0200, In re Matter of Certain Child Carriers, United States International Trade Commission, Inv. No. 337-TA-1154, Declaration of Di Linh Reichman Regarding the Hibiscus Carrier, Sep. 2, 2019, 6 pgs.
Exhibit RX-0206, In re Matter of Certain Child Carriers, United States International Trade Commission, Inv. No. 337-TA-1154, Color Photograph (Respondent Exhibit), Exhibit 301 to Depo of Reichman, 1 pg.
Exhibit RX-0208, In re Matter of Certain Child Carriers, United States International Trade Commission, Inv. No. 337-TA-1154, Color Photograph (Respondent Exhibit), Exhibit 302 to Depo of Reichman, 1 pg.
Exhibit RX-0210, In re Matter of Certain Child Carriers, United States International Trade Commission, Inv. No. 337-TA-1154, Color Photograph (Respondent Exhibit), Exhibit 303 to Depo of Reichman, 1 pg.
Exhibit RX-0212, In re Matter of Certain Child Carriers, United States International Trade Connnission, Inv. No. 337-TA-1154, Color Photograph (Respondent Exhibit), Exhibit 304 to Depo of Reichman, 1 pg.
Exhibit RX-0214, In re Matter of Certain Child Carriers, United States International Trade Commission, Inv. No. 337-TA-1154, Color Photograph (Respondent Exhibit), Exhibit 305 to Depo of Reichman, 1 pg.
Exhibit RX-0216, In re Matter of Certain Child Carriers, United States International Trade Commission, Inv. No. 337-TA-1154, Color Photograph (Respondent Exhibit), Exhibit 306 to Depo of Reichman, 1 pg.
Exhibit RX-0218, In re Matter of Certain Child Carriers, United States International Trade Commission, Inv. No. 337-TA-1154, Color Photograph (Respondent Exhibit), Exhibit 307 to Depo of Reichman, 1 pg.
Exhibit RX-0231, In re Matter of Certain Child Carriers, United States International Trade Commission, Inv. No. 337-TA-1154, Declaration of Kristin Dybvig-Pawelko regarding the No Tie Mei Tai Hibiscus Child Carrier Exhibit 7 to Depo of Dr. DybwigPawelko, Sep. 28, 2019, 9 pgs.
Exhibit RX-0235, In re Matter of Certain Child Carriers, United States International Trade Commission, Inv. No. 337-TA-1154, Color Photograph labeled A (Respondent Exhibit), Exhibit 320 to Depo of Dr. Dybwig-Pawelko, 1 pg.
Exhibit RX-0237, In re Matter of Certain Child Carriers, United States International Trade Commission, Inv. No. 337-TA-1154, Color Photograph labeled B (Respondent Exhibit), Exhibit 320 to Depo of Dr. Dybwig-Pawelko, 1 pg.
Exhibit RX-0239, In re Matter of Certain Child Carriers, United States International Trade Commission, Inv. No. 337-TA-1154, Color Photograph labeled C (Respondent Exhibit), Exhibit 320 to Depo of Dr. Dybwig-Pawelko, 1 pg.
Exhibit RX-0240, In re Matter of Certain Child Carriers, United States International Trade Commission, Inv. No. 337-TA-1154, Color Photograph labeled D (Respondent Exhibit), Exhibit 320 to Depo of Dr. Dybwig-Pawelko, 1 pg.
Exhibit RX-0241, In re Matter of Certain Child Carriers, United States International Trade Commission, Inv. No. 337-TA-1154, Omni Alternate Preliminary—For Review Only (PowerPoint) 10 pgs.
Exhibit RX-0242, In re Matter of Certain Child Carriers, United States International Trade Commission, Inv. No. 337-TA-1154, Color Photograph labeled E (Respondent Exhibit), Exhibit 320 to Depo of Dr. Dybwig-Pawelko, 1 pg.
Exhibit RX-0280, In re Matter of Certain Child Carriers, United States International Trade Commission, Inv. No. 337-TA-1154, TheBabyWearer post about carriers for facing out and referencing both Silly Goose and Pikkolo, Oct. 22, 2007, 9 pgs.
Exhibit RX-0289, In re Matter of Certain Child Carriers, United States International Trade Commission, Inv. No. 337-TA-1154, Pikkolo physical carrier and packaging, 12 pgs.
Exhibit RX-0296, In re Matter of Certain Child Carriers, United States International Trade Commission, Inv. No. 337-TA-1154, Tula Free-to-Grow Carrier Instruction Manual, 25 pgs.

(56) References Cited

OTHER PUBLICATIONS

Exhibit RX-0297, In re Matter of Certain Child Carriers, United States International Trade Commission, Inv. No. 337-TA-1154, Tula Explore Carrier Instruction Manual, 8 pgs.
"Blowing Experience," The Australian Women's Weekly, National library of Australia http://nla.gov.au/nla-newspage5623014, Oct. 11, 1978, 1 page.
"6 in One Rider," Infantino, LLC, San Diego, California, 2002, 1 page.
"Baby Matey, Soft Baby Carriers," Copyright Kidpower Unlimited Inc., 4 pages.
"Baby Pack Baby Carrier," http://www.beginnings.org/shop/buikrugdragers_babypack.htm, Feb. 4, 2002, 1 page.
"Baby Trekker instruction Sheet," 2 pages.
"Baby/Toddler Sling," http://www3.telus.net/public/a6a83106/Sling/sling.htmL, Nov. 19, 2003, 5 pages.
"Backpack Tips," http://backpacking.net/ gearpack-tips.html,Jun. 2, 2002, 6 pages.
"Blowing Experience," The Australian Women's Weekly, National library of Australia—http://nla.gov.au/nla-news-page5623014, Oct. 11, 1978, 1 page.
"Chinese Baby Carrier," http://portebebe.free.fr, Jun. 2002, 7 pgs.
"Clinical Practice Guideline: Early Detection of Developmental Dysplasia of the Hip," American Academy of Pediatrics vol. 105, No. 4, Apr. 2000, 10 pages.
"Device for Worn Baby," Patent Translate Description of Russian Application No. RU12646, 3 pgs.
"Eager Market for Baby Carrier" The Gazette, Montreal May 15, 1984: C-19 (accessed at https://news.google.corn/newspapersid~zA0vAAAAIBAJ&sjid~mqUFAAAAIBAJ&pg~l454% 2C24685 1 0).
"First Journey Advantages," http://www.first-journey.com/advantage2pics/advantages2.html, Dec. 14, 2002, 1 page.
"First Journey Advantages," http://www.first-journey.com/advantagelpics/advantages1.html, Dec. 14, 2002, 1 page.
"First Journey Advantages," http://www.first-journey.com/advantagelpics/advantagesl.html, Dec. 14, 2002, 1 page.
"First Journey Instructions," http://www.first-journey.com/instructions/instructions, Dec. 14, 2002, 1 page.
"First Journey Photos & Quotes," http://www.first-journey.com/photosandquotes/photos, Dec. 14, 2002, 2 page.
"First Journey Tour Guide," Pettersen Infant Products, www.firstjourney.com, 2002, 2 pages.
"First Journey Visite Guidee," Pettersen Infant Products, www.firstjourney.com, 2004, 2 pages.
"For Shane Gould Innes—Motherhood is a Mind," The Australian Women's Weekly, National library of Australia—http://nla.gov.au/nla-news-page5623013, Oct. 11, 1978, 1 page.
"Graco Soft Carrier Owner's Manual, Model 5070 Series," Graco Children's Products, Inc., 1999, 7 pages.
"GYP Gear G4," http://www.gvogear.com/g4.asp, Jun. 2, 2002, 3 pages.
"Home Watch," The Sydney Morning Herald, https://www.newspapers.com/image/123957115, Jan. 10, 1993, 1 page.
"In & Out Carrier Instructions," Hauck Fun for Kids, 2003, 3 pages.
"In & Out Carrier Instructions," Hauck Fun for Kids, Aug. 2003, 3 pages.
"Kinderpack Wearing Instructions for Infant Size," https://mykinderpack.com/pages/instructions, Copyright 2017 Kindercarry, 5 pgs.
"Kinderpack Wearing Instructions for Toddler Size," https://mykinderpack.corn/pages/instructions Copyright 2017 Kindercarry, 5 pgs.
"Kwik Sew," Pattern 1046, Kwik Sew Pattern Co., Inc., Minneapolis, MN, 8 pages.
"Lifter Baby Carrier," http://www.beginnings.org/shop/buikheuprugdragers_lifter.htm, Jun. 19, 2002, 2 pages.
"Make Your Own G4 Pack," http://www.gvpgear.com/make_your_own.asp, Jun. 2, 2002, 17 pages.
"Miguel Inspired Originals," http://miguelinspired.com/about.html, Oct. 30, 2005, 2 pages.
"Miguel Inspired Originals," http://miguelinspired.com/gpage.html, Oct. 30, 2005, 2 pages.
"Miguel Inspired Originals," http://miguelinspired.com/gpage.html, Oct. 30, 2005, 2 pgs.
"Porte-hebe chinois," http://portebebe.free.fr/, Jun. 5, 2002, 6 pages.
"The Australian Women's Weekly," vol. 37, No. 8, Jul. 23, 1969, 80 pages.
"The Baby Trekker Product Info," http://www.babytrekker.com/product.htm, Jun. 10, 2002, 1 page.
"The Baby Trekker Testimonials," http://www.babytrekker.com/testimonials.htm, Dec. 21, 2001, 4 pages.
"The Baby Trekker Testimonials," http://www.babytrekker.com/testimonials.htm, Sep. 16, 2002, 4 pages.
"The Five Hidden Features of the Yemaya Baby Carrier," <>, Oct. 13, 2016 ISARA, 7 pgs.
"The Pick of the Extended Trek Packs" Backpacker, Oct. 1997, vol. 23, pp. 58-69.
"Theodore Bean Infants & Toddlers Carriers & Accessories," Theodore Bean Adventure Company Inc., 2000, 16 pages.
"Ultralight Pack,"http://www.backpacking.net/makegear/ gvppack/, Mar. 1, 2003, 29 pgs.
"Why Choose the Wilkin et?," http://www.wilkinet.co.uk/WhyChoose.asp, Apr. 17, 2003, 2 pages.
"Worauf Eltern beim Kauf von Tragehilfen fuer Sauglinge achten sollten"—Things parents shopping for infant carriers should look out for, <>, Jul. 19, 2001, 4 pages.
Appendix A: Baby Matey Non-Patent Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix AAA: Japanese Pub. No., S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix BB: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix BB: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix BBB: UK Patent App. No. GB 2026848 ("David") Invalidity Chart, *The Ergo Baby Carrier, Inc.* v. *BOBA Inc.*, Case No. 2: 15-cv-08946, In the United States District Court for the Central District of California, Jul. 15, 2016, 5 pgs.
Appendix C: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Kirkilionis, E., Die Grundbediirfnisse des Sauglings und deren medizinische Aspekte—<largestellt und charakterisiert am Jungentypus Tragling. notabene medici, 1997, 27 (2), 61-66, 27 (3), 117-121.
Kirkilionis, E., Ein Baby will gatragen sein, 1999, 171 pgs."The Beginning" Ergo Baby Blog, 13 pgs., retrieved from https:// blog.ergobaby.corn/2011/02/the-beginning/.
Kirkilionis, E., Worauf Eltern beim Kauf von Tragehilfen fiir Sauglinge achten sollten, 1994.
Knapik, J., "Physiological, Biomechanical and Medical Aspects of Soldier Load Carriage", RTO HFM Specialist Meeting on Soldier Mobility Innovation in Load Carriage System Design and Evaluation, Kingston, CA, Jun. 27-29, 2000, 20 pgs.
Korean Patent Application No. 10-2019-7015083, Notice of Allowance, mailed Oct. 25, 2022.
KR Application No. 10-2019-7015083 Korean Office Action dated Apr. 28, 2022.
Krantz, L. and Ludman-Exley, S., "The Best of Everything for Your Baby," Copyright 2000 by Prentice Hall, Inc., 18 pages.
Laury, Jean Ray, Baby Carrier, A Treasury of Needlecraft Gifts for the New Baby, 1976, pp. 90-93.

(56) References Cited

OTHER PUBLICATIONS

Leveau, Barney F., et al., "Developmental biomechanics," Physical Therapy, 64.12, 1984:1878.
Longe, J., "How Products are Made: An Illustrated Guide to Product Manufacturing," 2001, vol. 6, 8 pages.
Mackie, H.W. et al., "The effect of simulated school load carriage configurations on shoulder strap tension forces and shoulder interface pressure", Applied Ergonomics, 36, 2005, pp. 199-206.
Martin, et al., "A Mathematical Model of the Inertial Properties of a Carrier-Backpack System vol. IV", United States Army Natick, Research and Development Laboratories, Natick, MA, May 1982, 89 pgs.
Martin, et al., "Effects of Gender, Load, and Backpack on the Temporal and Kinematic Characteristics of Walking Gait vol. III", United States Army Natick, Research and Development Laboratories, Natick, MA, Apr. 1982, 77 pgs.
Martin, J. and Hooper, R., "Military Load Carriage: A Novel Method of Interface Pressure Analysis," RTO HFM Specialists' Meeting on "Soldier Mobility: Innovations in Load Carriage System Design and Evaluation," Jun. 27-29, 2000, 9 pgs.
Moriguchi Yuko, JP-2014176494A, Google translation, Sep. 2014, 14 pgs.
Nelson, et al., "Effects of Gender, Load, and Backpack on Easy Standing and Vertical Jump Performance vol. II", United States Army Natick, Research and Development Laboratories, Natick, MA, Mar. 1982, 77 pgs.
Newspaper ad for Napsak Soft Baby Carrier by Evenflow, The Pittsburgh Press (Pittsburgh, Pennsylvania), Thursday, Dec. 12, 1991, p. 57.
Notice of Allowance (with English translation) for Korean Patent Application No. 10-2018-7015023, dated Jul. 9, 2020, 10 pgs.
Notice of Allowance for U.S. Appl. No. 15/337,813, dated Feb. 14, 2019, 2 pgs.
Notice of Allowance for U.S. Appl. No. 15/337,813, dated Nov. 5, 2018, 2 pgs.
Notice of Allowance for U.S. Appl. No. 15/796,422, dated Jul. 25, 2019, 5 pgs.
Notice of Allowance for U.S. Appl. No. 16/204,581, dated Aug. 19, 2019, 5 pgs.
Notice of Allowance for U.S. Appl. No. 16/204,581, dated Oct. 9, 2019, 3 pgs.
Notice of Allowance for U.S. Appl. No. 16/551,286, dated Aug. 18, 2020, 2 pgs.
Notice of Allowance for U.S. Appl. No. 16/551,286, dated Jan. 19, 2021, 2 pgs.
Notice of Allowance for U.S. Appl. No. 16/682,288, dated Apr. 26, 2021, 3 pgs.
Notice of Allowance for U.S. Appl. No. 16/682,288, dated Mar. 2, 2021, 3 pgs.
Notice of Commission Determination to Review in Part a Final Initial Determination Finding No Violation of Section 337; Termination of the Investigation, 85 Federal Register 95, at 29484-29485, May 15, 2020, 2 pgs.
Notice of Opposition filed on Mar. 13, 2012, against European Patent No. EP1765123 B1, 213 pgs.
Nov. 24, 1998 Letter from U.S. ITC regarding U.S. tariff classification of babyTrekker, 2 pgs., retrieved from http://www.faqs.org/rulings/rulingsl998NYD8338 1 .htrnl).
O'Donohue, Rosaleen, Baby Rides the Asian Way, The Australian Women's Weekly, Jul. 23, 1969 at p. 9.
Office Action (with English translation) for Chinese Patent Application No. 201680071536.X, dated Nov. 16, 2020, 16 pgs.
Office Action (with English translation) for Korean Patent Application No. 10-2018-7015023, dated Dec. 17, 2019, 10 pgs.
Office Action (with English translation) for Korean Patent Application No. 10-2020-7029046, dated Oct. 22, 2020, 11 pgs.
Office Action for Chinese Patent Application No. 201480023993.2, dated Jan. 11, 2017, 20 pgs.
Office Action for Chinese Patent Application No. 201480023993.2, dated Sep. 26, 2017, 5 pages.
Office Action for European Patent Application No. 14773586.4, dated Oct. 12, 2017, 5 pages.
Office Action for Japanese Patent Application No. 2016-502118, dated Apr. 7, 2017, 9 pages.
Office Action for Japanese Patent Application No. 2017-552901 (with English translation), dated Feb. 19, 2019, 9 pgs. International Preliminary Report on Patentability (IPRP) for International Application No. PCT/US2017/058820, dated May 9, 2019, 11 pgs.
Office Action for Japanese Patent Application No. 2018-521974 dated Aug. 1, 2020, 5 pgs.
Office Action for Japanese Patent Application No. 2018-521974 dated Aug. 14, 2020.
Office Action for Japanese Patent Application No. 2020-060090, dated Feb. 19, 2021, 2 pg.
Office Action for Korean Patent Application No. 10-2015-7028949, dated Jul. 20, 2017, 20 pages.
Office Action for Korean Patent Application No. 10-2018-7015023, dated Dec. 17, 2019, 5 pgs.
Office Action for U.S. Appl. No. 10/937,193, dated Aug. 14, 2007,9 pgs.
Office Action for U.S. Appl. No. 11/949,324, dated Apr. 28, 2010, 9 pgs.
Office Action for U.S. Appl. No. 11/949,324, dated Jul. 18, 2011, 14 pgs.
Office Action for U.S. Appl. No. 11/949,324, dated Oct. 4, 2010, 10 pgs.
Office Action for U.S. Appl. No. 14/685,235, dated May 22, 2015, 8 pgs.
Japanese Patent Application 2021-529471 Office Action issued Oct. 18, 2023.
European Patent Application 23175400.3 Extended Search Report issued Nov. 16, 2023.
Chinese Patent Application 202111280861.6 First Office Action issued Dec. 27, 2023.
European Patent Application 23181194.4 Extended Search Report issued Jan. 4, 2024.
European Patent Application 16860977.4 Office Action issued Jan. 29, 2024.
European Patent Application 2317400.3 Extended Search Report issued Nov. 16, 2023.
Japanese Patent Application 2021-529471 Notice of Allowance issued May 28, 2024.
European Patent Application 21180405.9 Notice of Opposition issued Mar. 13, 2023.
Japanese Patent Application 2021-529471 Penultimate Official Action issued Feb. 19, 2024.
Babybjörn AB, Owner's Manual, Babybjörn Baby Carrier Free, Version 1, 2019, www.babybjorn.com.
BabyBjörn AB, Owner's Manual, BabyBjörn Baby Carrier Harmony, Version 4, 2019, www.babybjorn.com.
BabyBjörn AB, Owner's Manual, BabyBjörn Baby Carrier Mini, Version 5, 2018, www.babybjorn.com.
BabyBjörn AB, Owner's Manual, BabyBjörn Baby Carrier Miracle, Version 5, 2011, www.babybjorn.com.
BabyBjörn AB, Owner's Manual, BabyBjörn Baby Carrier Move, Version 2, 2019, www.babybjorn.com.
BabyBjörn AB, Owner's Manual, BabyBjörn Baby Carrier Original, Version 9, 2015, www.babybjorn.com.
BabyBjörn AB, Owner's Manual, BabyBjörn Baby Carrier We, Version 2, 2015, www.babybjorn.com.
Portier, Limited Edition Limitlesscarrier—Papillon Denim, https://portier.com.au/collections/featured/products/limited-edition-limitless-carrier-papillon-denim.
Rookie, Instructions Rookie Affinity, https://rookie-baby.eu/pages/instructions-rookie-affinity.
Rookie, Instructions Rookie Konnekt Baby Carrier, https://rookie-baby.eu/pages/instructions-rookie-konnekt-baby-carrier-1.
Rookie, Instructions Rookie Premium Baby Carrier, https://rookie-baby.eu/pages/instructions-premium-baby-carrier.
Rookie, Instructions Rookie Revolution Baby Carrier From New Born to Toddler, https://rookie-baby.eu/pages/instructions-revolution-baby-carrier.

(56) References Cited

OTHER PUBLICATIONS

U.S. Appl. No. 17/572,084, Notice of Allowance issued Jan. 18, 2024.
U.S. Appl. No. 18/108,979, Non-Final Office Action issued Jan. 18, 2024.
U.S. Appl. No. 18/526,378 Non-Final Office Action issued Feb. 1, 2024.
European Patent Application 19889231.7 Intent to Grant issued Mar. 25, 2024.
European Patent Application 21180405.9 Notice of Opposition issued Apr. 2, 2024.
U.S. Appl. No. 18/243,500 Non-Final Office Action issued Apr. 17, 2024.
European Patent Application 19889231.7 Communication pursuant to Rule 114(2) EPC issued Apr. 16, 2024.
Screen captures of transcript from YouTube video clip entitled "Ergobaby Adapt Carrier Instructions Front Inward with "H" straps," 7 pages, uploaded on Jul. 4, 2016, by user "Ergobaby UK & Ireland". Retrieved from Internet: https://www.youtube.com/watch?v=pET5hq_hfL8&ab_channel=ErgobabyUK%26Ireland.
Exhibit RX-0512, In re Matter of Certain Child Carriers. United States International Trade Commission, Inv. No. 337-TA-1154, Exhibit I to Deciaration of Joline Sikora, 2007), 3 pgs.

* cited by examiner

ADJUSTABLE CHILD CARRIER WITH MULTIPLE CARRY ORIENTATIONS

RELATED APPLICATIONS

This application is a continuation of U.S. patent application Ser. No. 17/689,554 filed Mar. 8, 2022; which is a continuation of U.S. patent application Ser. No. 16/872,244 filed May 11, 2020, now U.S. Pat. No. 11,297,957, issued Apr. 12, 2022; which is a continuation of U.S. patent application Ser. No. 15/796,422 filed Oct. 27, 2017, now U.S. Pat. No. 10,736,436, issued Aug. 11, 2020; which claims the benefit of U.S. Provisional Application No. 62/414,564 filed Oct. 28, 2016, the disclosures of which are all hereby fully incorporated herein in its entirety for all purposes.

TECHNICAL FIELD

The present disclosure relates to child carriers. Even more particularly, the present disclosure relates to a child carrier that is adaptable to ergonomically carry a child as the child grows.

BACKGROUND

Various child carriers are currently available for transporting a child by a parent or other individual. Child carriers have become popular for carrying infants and toddlers because they afford the wearer freedom of hand and arm movement while carrying a child. In pursuit of child safety, some of these devices have become overly complex involving, among other things, rigid seats and frames which considerably increase the weight of the carrier and cannot accommodate for the growth of the child. These complex carriers are relatively heavy and place an undue strain upon the wearer, particularly in the lumbar region. In addition, because of the size of many of the present day carriers, they can only be worn on the back thus denying the child the comfort and security of a position where a child and its mother may be in a face-to-face relationship.

Soft structured carriers have become increasingly popular because they are lighter, less cumbersome and more comfortable to wear. These carriers incorporate padding, stitching and fabrics, rather than a rigid frame, to provide the structure. However, some soft-structured carriers hold a child in an upright position with the child's legs hanging down and the base of the child's spine supporting the child's bodyweight. This position may not be optimal for infant and other young children. While an adult spine has four curves, a young child's spine only has two curves. A majority of a young child's spine will form a C-shape (so-called total kyphosis). Positioning a young child, particularly an infant, in an upright position may unduly limit curvature of the spine and puts stress on the infant's sacrum. This can cause the infant's pelvis to tilt backward limiting leg and hip movement, which may impede healthy development of the infant's pelvis.

Moreover, conventional soft structured carriers are usually designed for a very limited age, weight and size of child and make compromises regarding the shape of the carrier to accommodate a range of ages. Even if a carrier supports ergonomic positioning of the child at one age/weight/size, positioning a child in an ergonomic position through the range of ages while utilizing the same carrier poses a problem as different children develop at different rates and the anatomy and physiology of children changes dramatically between infancy and toddlerhood.

A carrier designed for infants or younger babies may not accommodate a child as the child grows into toddlerhood because the seat and back support portions of the carrier will become too small. In an attempt to make carriers more adaptable, some carriers provide additional panels that can be unfolded and added to the seat to widen the seat and/or back panels that can expand (e.g., by unfolding additional back panel material or attaching new panels) to accommodate the child's growth. However, simply widening the seat or lengthening the carrier does not adequately address proper ergonomics.

On the other hand, a carrier designed for older children may not properly support an infant. One solution to this problem is the use of a specially designed "infant insert." In general, an infant insert is an accessory that incorporates additional padding and structure and makes it possible to carry a small infant in a carrier that would not otherwise properly support the infant. However, not all carriers support the use of infant inserts. Moreover, depending on design, infant inserts may be cumbersome, non-intuitive, and easily lost. In particular, the use of a separate infant insert may require that parents keep track of two separate devices and may significantly increase the difficulty of configuring the carrier for a wearer, the wearing of the carrier, or the ingress and egress of a child to the carrier.

Furthermore, many carriers provide limited flexibility, only allowing the child to be properly oriented in a single orientation either facing the wearer or looking away from the wearer. Due to the foregoing issues, parents often opt for changing carriers as the child ages.

SUMMARY

Embodiments described herein provide an adjustable child carrier that is adjustable to ergonomically support a carried child in multiple carrying positions (multi-position) and multiple carrying orientations (multi-orientation). According to one embodiment, a multi-position, multi-orientation child carrier comprises a waist belt adapted for securing about a wearer's hips and a main body coupled to the waist belt. The main body is adapted to form a child carrying area in cooperation with a wearer's torso. The main body comprises a torso support portion configured for supporting at least of the torso of a child, a seat portion, a first thigh support strap and a second thigh support strap. The first thigh support strap and second thigh support strap are adapted to cooperate with the seat portion to form an adjustable bucket seat configurable in a plurality of bucket seat configurations. The first thigh support strap and second thigh support strap are adapted to selectively secure to the torso support portion and waist belt at multiple locations to provide a plurality of bucket seat configurations. Each of the plurality of bucket seat configurations can have a bucket seat depth and bucket seat width and be adapted to support a child in a corresponding size range in a spread squat position. According to one embodiment, the plurality of bucket seat configurations comprises a configuration adapted to support an infant in a spread squat position without an infant insert. The plurality of bucket seat configurations may also comprise a configuration adapted to support a toddler in a spread squat position. The child carrier may have a wearable height that is dependent on the bucket seat depth.

According to one embodiment, the bucket seat configurations include a first configuration adapted to support a child in a first size range in a first corresponding spread squat position in first orientation, a second configuration adapted to support a child in a second size range in a second corresponding spread squat position in the first orientation, a third configuration adapted to support a child in a third size range in the first orientation in a third corresponding spread squat position and a fourth configuration adapted to support a child in a second orientation in a fourth corresponding spread squat position. In one embodiment, the first orientation in an inwardly facing orientation and the second orientation is an outwardly facing orientation. The first configuration may have a first bucket seat base width and first bucket seat depth, the second configuration may have a second bucket seat base width and a second bucket seat depth, the third configuration may have a third bucket seat base width and third bucket seat depth, wherein the first bucket seat base width is less than the second bucket seat base width, the first bucket seat depth is greater than the second bucket seat depth, the second bucket seat base width is less than the third bucket seat base width and the second bucket seat depth is greater than the third bucket seat depth. The fourth configuration may have a bucket seat top width that is less than the first configuration, second configuration or third configuration top width.

The child carrier may comprise a base width adjustment and a top width adjustment, wherein the base width adjustment mechanism is adapted to selectively couple the first thigh support strap and second thigh support strap to the waist belt and the top width adjustment is adapted to selectively couple the first thigh support strap and second thigh support strap to the torso support portion.

According to one embodiment, the base width adjustment comprises a first base width adjuster coupled to the first thigh support strap and a second base width adjuster coupled to the second thigh support strap, the first base width adjuster and second base width adjuster configured for selective coupling to the waist belt in multiple locations to adjust the bucket seat depth.

The child carrier may further comprise a shaping member adapted to control a bulge of the bucket seat. According to one embodiment, the child carrier includes a first gusset disposed between a seat center portion and first thigh support strap, the first gusset having a first gusset first free edge spanning between the first thigh support strap and seat center portion and a first gusset second free edge spanning between the first thigh support strap and seat center portion, and a second gusset disposed between the seat center portion and the second thigh support strap, the second gusset having a second gusset first free edge spanning between the second thigh support strap and seat center portion and a second gusset second free edge spanning between the second thigh support strap and seat center portion. The first gusset may be adapted to open or close responsive to adjusting the first base width adjuster and the second gusset may be adapted to open or close responsive to adjusting of the second base width adjuster.

The base width adjustment can be configurable in a first setting corresponding to a maximum bucket seat depth and a second setting corresponding to a minimum bucket seat depth. The first gusset and second gusset can have a first shape corresponding to the first setting and a second shape corresponding to the second setting. According to one embodiment, the first base width adjuster and second base width adjuster are adjustable through rotation to rotate the first thigh support strap and second thigh support strap relative to laterally outer edges of the seat center portion to open or close the first gusset and second gusset.

The child carrier, according to one embodiment, further comprises a neck support configurable in an inside folded down position in which the neck support is positioned in the child carrying area to support a child's neck. The neck support may be further configurable in an extended folded up position and an outside folded down position.

A method for configuring a multi-orientation, multi-position child carrier comprising a torso support portion configured for supporting at least the torso of a child, a seat portion, a first thigh support strap and a second thigh support strap, can include adjusting a bucket seat of the child carrier formed by the seat portion, first thigh support strap and second thigh support strap to a child's size and orientation. Adjusting the bucket seat to the child's size and orientation may further comprise selectively coupling the first thigh support strap and the second thigh support strap to the torso support portion at connection points corresponding to the orientation configuring the depth of the bucket seat by coupling base width adjusters of the child carrier to a waist belt of the child carrier at positions for a base width setting corresponding to the child's size. The child can be positioned in the child carrying area of the child carrier in the orientation such that the child is supported in an ergonomic spread squat position.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

Figure 1:
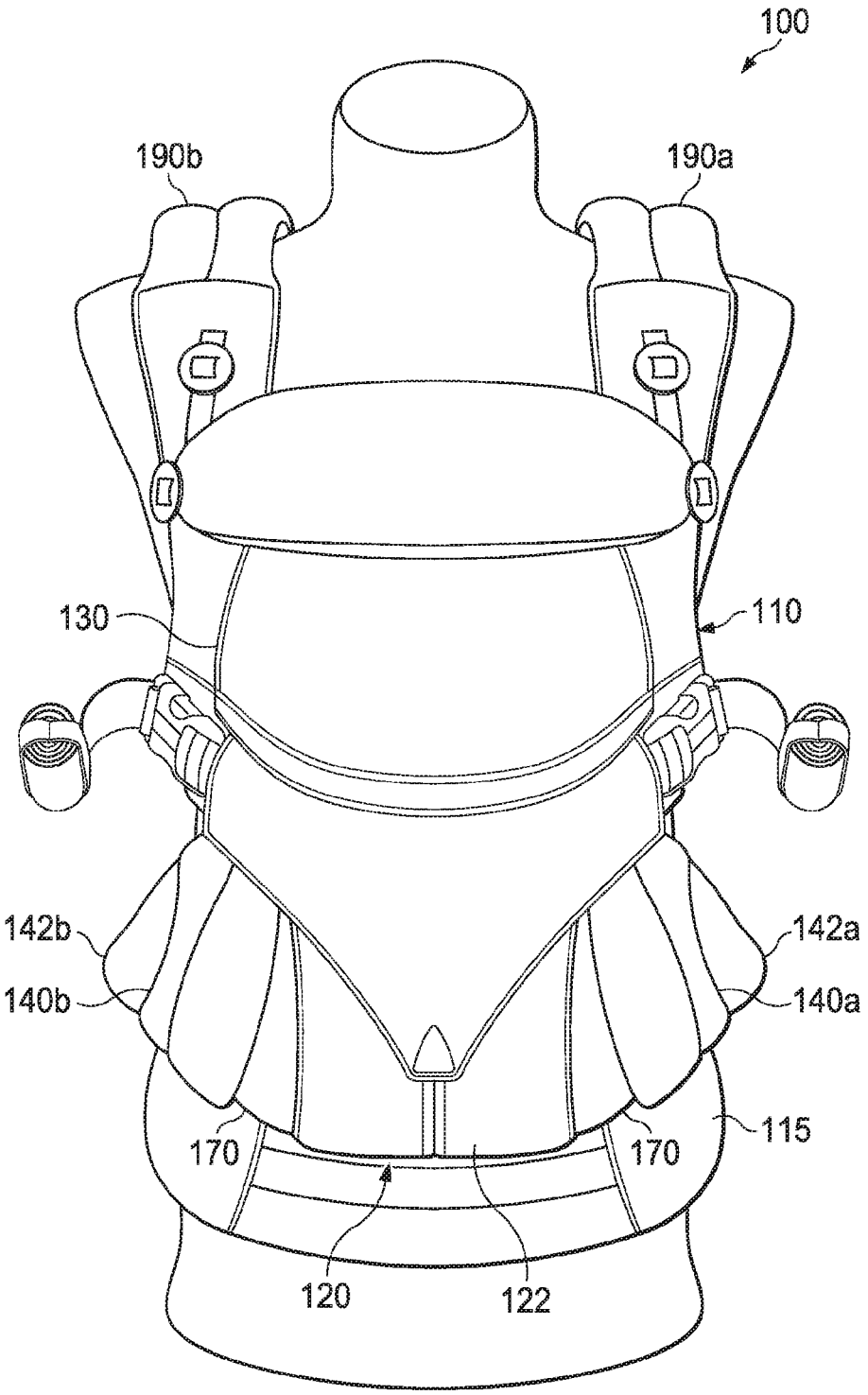
FIG. 1 is a diagrammatic representation of an outside view of one embodiment of an adjustable carrier worn on a torso.

Child carriers and related methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

The present disclosure relates to child carriers that allow a child, including an infant, to be carried in a manner that supports the child and maintains the child's pelvis and thighs in a preferred ergonomic position through a range of ages. In particular, embodiments described herein provide carriers that support the child's bottom, pelvis and thighs in a desired position. Embodiments described herein also allow a child to be carried on the front or back or to the side of the person carrying the child. The carrier can be worn by a user in front of, in back of or to the side of the wearer with the child's weight carried near the wearer's center of gravity and close to the wearer's front, back or side in a front, back or side position, respectively. In addition, the child may be oriented in an inward facing orientation or outward facing orientation in at least one of the positions.

In accordance with one aspect of the present disclosure, a carrier includes a bucket seat that can be adjusted in multiple configurations. A first configuration may be adapted to support a child of a first size range in a first orientation in a corresponding first spread squat position, a second configuration may be adapted to support a child of a second size range in the first orientation in a second corresponding spread squat position, a third configuration may be adapted to support a child of a third size range in the first orientation in a third corresponding spread squat position. The first configuration may have a first bucket seat width and first bucket seat depth, the second configuration may have a second bucket seat width and a second bucket seat depth, and the third configuration may have a third bucket seat width a third bucket seat depth. According to one embodiment, the first bucket seat width is less than the second bucket seat width, the first bucket seat depth is greater than the second seat bucket depth, the second bucket seat width is less than the third bucket seat width and the second bucket seat depth is less than the third bucket seat depth. The carrier may be further configurable in a fourth configuration adapted to support a child in a second orientation in a fourth corresponding spread squat position. The first orientation may be an inward facing orientation and the second orientation may be an outward facing orientation.

More particularly, in one embodiment, a carrier includes a bucket seat for a child and one or more adjustments that when adjusted serve to adjust a depth of the seat bucket and a height of the child carrier. When adjusted to a newborn setting, the carrier is configured such that the depth of the seat bucket may be at a maximum. Conversely, when adjusted to its maximum, or largest size, setting (e.g., a setting for the largest child the carrier is designed to accommodate) the depth of the seat bucket may be at a minimum. When the depth of the bucket seat is at a maximum the thighs may be supported such that the angle of the thighs of the child relative to the coronal plane may be greatest and when the depth of the bucket seat is at a minimum the thighs may be supported such that the angle of the thighs of the child relative to the coronal plane may be the smallest. Similarly, then, the bucket seat is at a maximum, the carrier may be configured such that the carrier maintains a child carried therein with relatively more curve in their spine than when the bucket seat is at a minimum depth.

For example, a child carrier may include one or more adjustment points that work alone or in cooperation to adjust the shape of the bucket seat area provided by the child carrier. These adjustment points can be configured to adjust a seat top width, seat base width, seat bucket depth, and carrier height. According to one embodiment, the adjustment points include base width adjustment points adapted to adjust the width of the main panel of the baby carrier at a point where the main panel is coupled to the waistband of the carrier and seat top width adjustment points to adjust the width of the main panel where the seat couples to the upper torso portion of the main panel. Adjusting the width of the main panel may serve to provide maximum shape for the bucket area and thus maximum depth of the bucket seat area when adjusted to the narrowest setting for newborn babies and the minimal depth of the bucket seat area for the largest children when adjusted to the widest setting. Adjusting the width of the main panel may also serve to configure the carrier for carrying a child in an outward facing orientation or an inward facing orientation.

The carrier of certain embodiments may also be configured to adjust in height. In certain embodiments, the length of the physical carrier from the top edge of the waist belt at the center to the top edge of carrier at the center remains consistent, however, the wearable height changes depending on the setting of the bucket seat size. With the base width at its smallest/narrowest setting the bucket seat is deeper consuming more of the carrier length measurement, thus leaving less measurement for the wearable height while with the base width at is largest/widest setting the bucket seat is shallow consuming less of the carrier length measurement, thus leaving more measurement for the wearable height.

Embodiments of such carriers may also include an adjustable neck support. Such a neck support or collar that may be positioned according to the direction the child is facing, the size of the child, or other criteria. The adjustable neck support may be rotatable relative to the main panel such that the neck support may be extended increasing the center height of the carrier giving additional back or neck support for a child (depending on the size of the child). The neck support may also be folded back away from the wearer to reduce the height of the carrier (e.g., for non-infant children). The neck support may also be folded down into the carrier toward the wearer such that it may reside inside the child carrying area to give an infant or other child additional head or neck support.

The adjustable child carrier can be configured to accommodate children of a wide range of sizes in a front, rear or side carrying position while supporting the child's hips, pelvis, bottom and both upper thighs when the child is being carried in various orientations. For example, embodiments of a child carrier as disclosed herein may provide an adjustable child carrier usable with a newborn children (infant) (e.g., around 7 pounds) and additionally with children all the way to up to around 45 pounds or more. Embodiments may thus be sized appropriately to carry an infant without the use of an additional infant insert. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position.

According to another aspect, a child carrier is provided that allows a child to be carried in multiple orientations (e.g., inward facing and outward facing) in a manner that supports the child and maintains the child's pelvis and thighs in a preferred ergonomic position. Embodiments described allow a child to be carried in an outward facing orientation (i.e., facing away from the person carrying the child) or an inward facing orientation (i.e., facing toward the person carrying the child), and further allow the child to be carried on the front or back or to the side of the person carrying the child. In particular, embodiments described herein provide carriers that support the child's bottom, pelvis and thighs in a desired position in both an outward facing orientation and an inward facing orientation. The carrier can be worn by a user in front of, in back of or to the side the wearer with the child's weight carried near the wearer's center of gravity and close to the wearer's front, back or side in a front, back or side position, respectively.

The carrier can be ergonomic for the wearer as well. A padded waist belt may provide lumbar support and may cooperate with shoulder straps (that may attach to the same or opposite sides of the carrier) that can form a configurable harness that can position the carrier in a front, side or back carry position while distributing the weight evenly to the wearer. The carrier may be adjusted such that the child is positioned close to the wearer's center of gravity which distributes the child's weight evenly. In some embodiments, the harness may be adjusted so that a majority of the child's weight is transferred to the wearer's hips.

According to one embodiment, a child carrier includes a waist belt adapted for securing about a wearer's hips and a main body coupled to the waist belt, where the main body adapted to form a child carrying area in cooperation with a wearer's torso. The main body can include a torso support portion configured for supporting at least the torso of a child and an adjustable bucket seat configurable in a plurality of bucket seat configurations, each of the plurality of bucket seat configurations having a different bucket seat depth and bucket seat width and adapted to support a child in a corresponding size range in a spread squat position. In one embodiment, the plurality of bucket seat configurations comprises a configuration adapted to support an infant in a spread squat position without an infant insert. The plurality of bucket seat configurations may include a configuration adapted to support a toddler in a spread squat position.

In accordance with one embodiment, the main body may include a seat portion and thigh support straps disposed on either side of the seat portion. Each thigh support strap may have an inward end portion configured for selective coupling to the waist belt (or other structure) in multiple positions and an outward end portion configured for selective coupling to the upper torso support (or other structure) in multiple positions. When the thigh support straps are coupled to the upper torso support and waist belt, the seat portion and the thigh support straps cooperate to form an adjustable bucket seat to support a child in an ergonomic spread-squat position. The shape of the seat adjusts and depends on the positions in which the inward end portions and outward end portions of the thigh support straps are coupled to the waist belt and upper torso support. The carrier can be configurable to support the child in an ergonomic spread-squat position in multiple positions, including a back carry position, front carry position and side carry position and multiple orientations including inward facing and outward facing.

The child carrier may include one or more fabric shaping members adapted to control a bulge of the bucket seat. As one example, the fabric shaping members may comprise gussets disposed between the thigh supports and a seat center portion, where the gussets act as darts that are adapted to open or close responsive to adjusting the base width adjusters. The thigh support straps may be configurable in a first setting corresponding to a maximum bucket seat depth and a second setting corresponding to a minimum bucket seat depth, wherein the darts or other fabric shaping members have a first shape corresponding to the first setting and a second shape corresponding to the second setting.

Embodiments described herein provide an advantage over prior carriers because the ergonomic bucket seat gradually adjusts to a growing baby from newborn to toddler, to ensure baby is seated in an ergonomic spread-squat, natural "M shape" position at multiple stages.

As an additional advantage, embodiments described herein can provide an adjustable seat shape that does not require adding to or removing structure from the carrier to change the seat shape. For example, some embodiments can accommodate infants and larger children without requiring an infant insert for an infant.

Embodiments described herein can provide another advantage by allowing the carrier seat shape to be easily adjusted without adding or removing panels from the seat.

Embodiments described herein can provide another advantage by providing a carrier with a wearable length that can be adjusted without requiring complicated mechanisms to extend the overall length of the carrier.

Embodiments described herein provide another advantage by allowing the same carrier to support both inward and outward facing orientations in at least one position.

Figure 2:
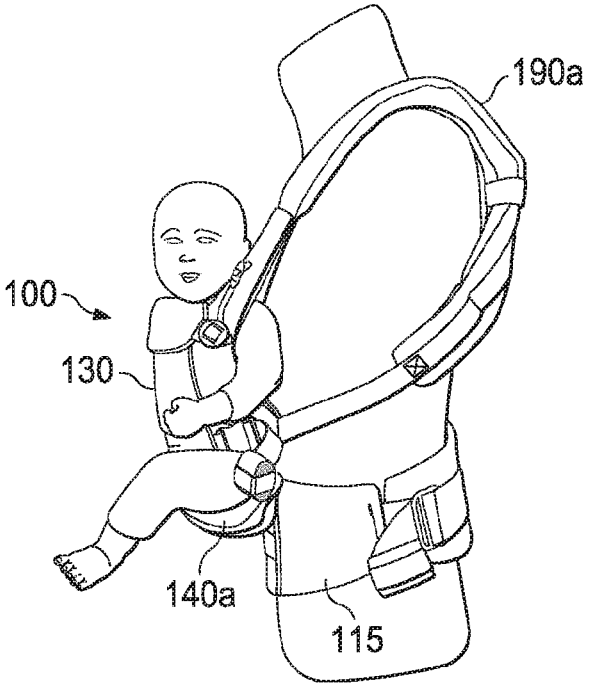
FIG. 2 is a side view of one embodiment of an adjustable child carrier worn in a front carry position with a child supported in an outward facing (facing away from the wearer) orientation.
Figure 3:
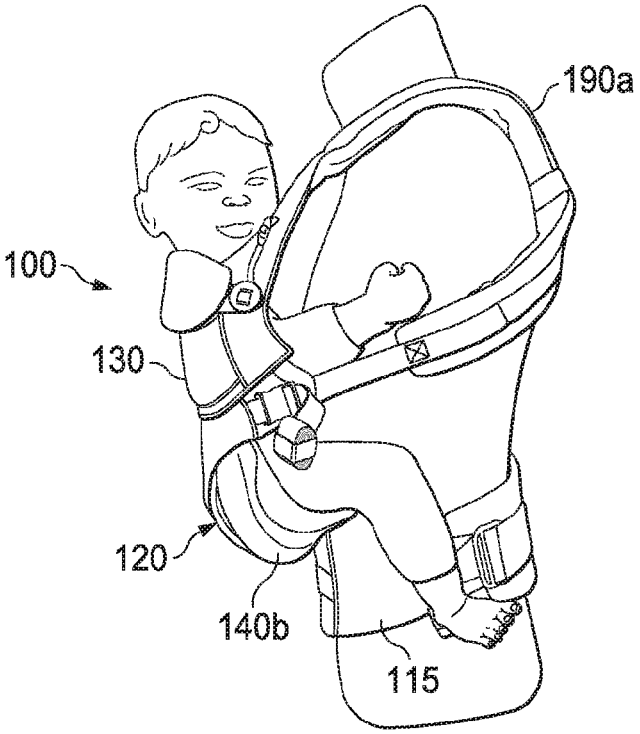
FIG. 3 is a side view of one embodiment an adjustable child carrier worn in a front carry position with a child supported in an inward facing (facing toward the wearer) orientation.
Figure 4:
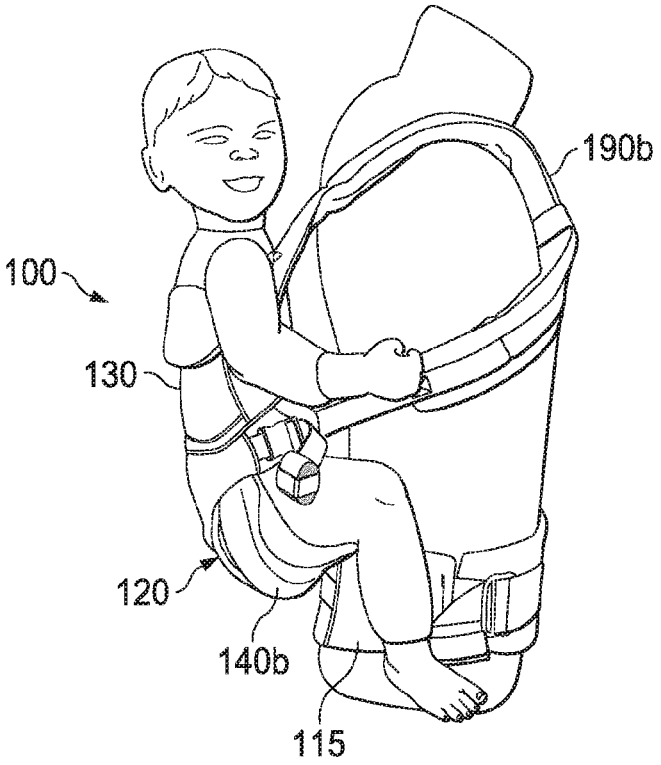
FIG. 4 is a diagrammatic representation of a side view of one embodiment of an adjustable child carrier worn in a back carry position with a child supported in an inward facing orientation.
Figure 5:
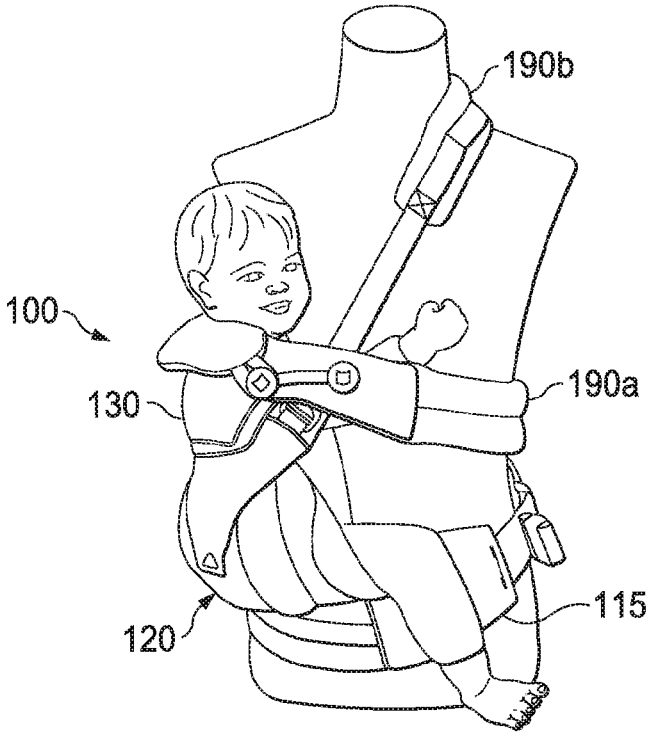
FIG. 5 is a diagrammatic representation of one embodiment of a child carrier in a side carry (or hip carry) position with a child supported in an inward facing orientation.
Figure 6A:
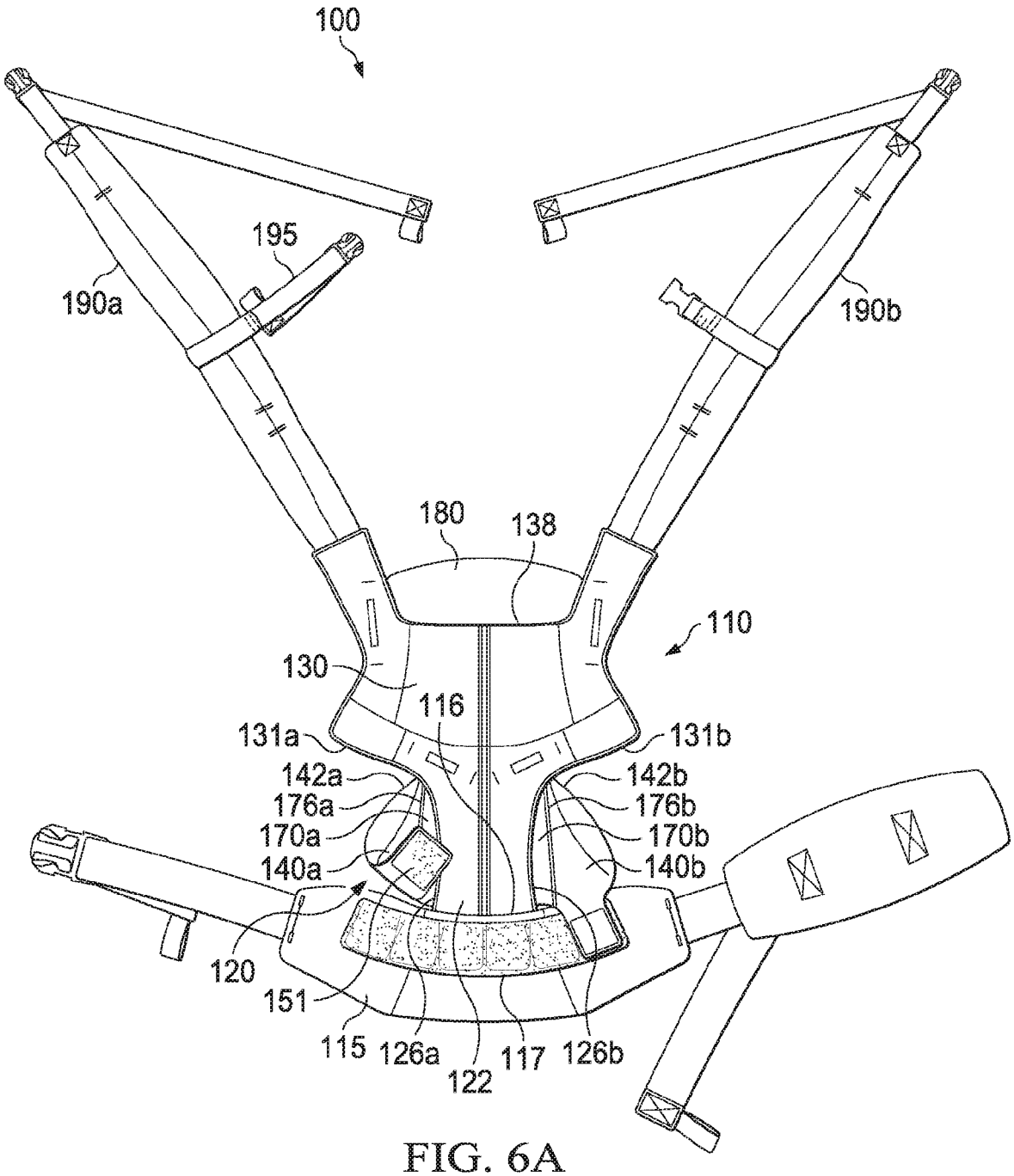
FIG. 6A is a diagrammatic representation of an inside view of one embodiment of an adjustable baby carrier.
Figure 6B:
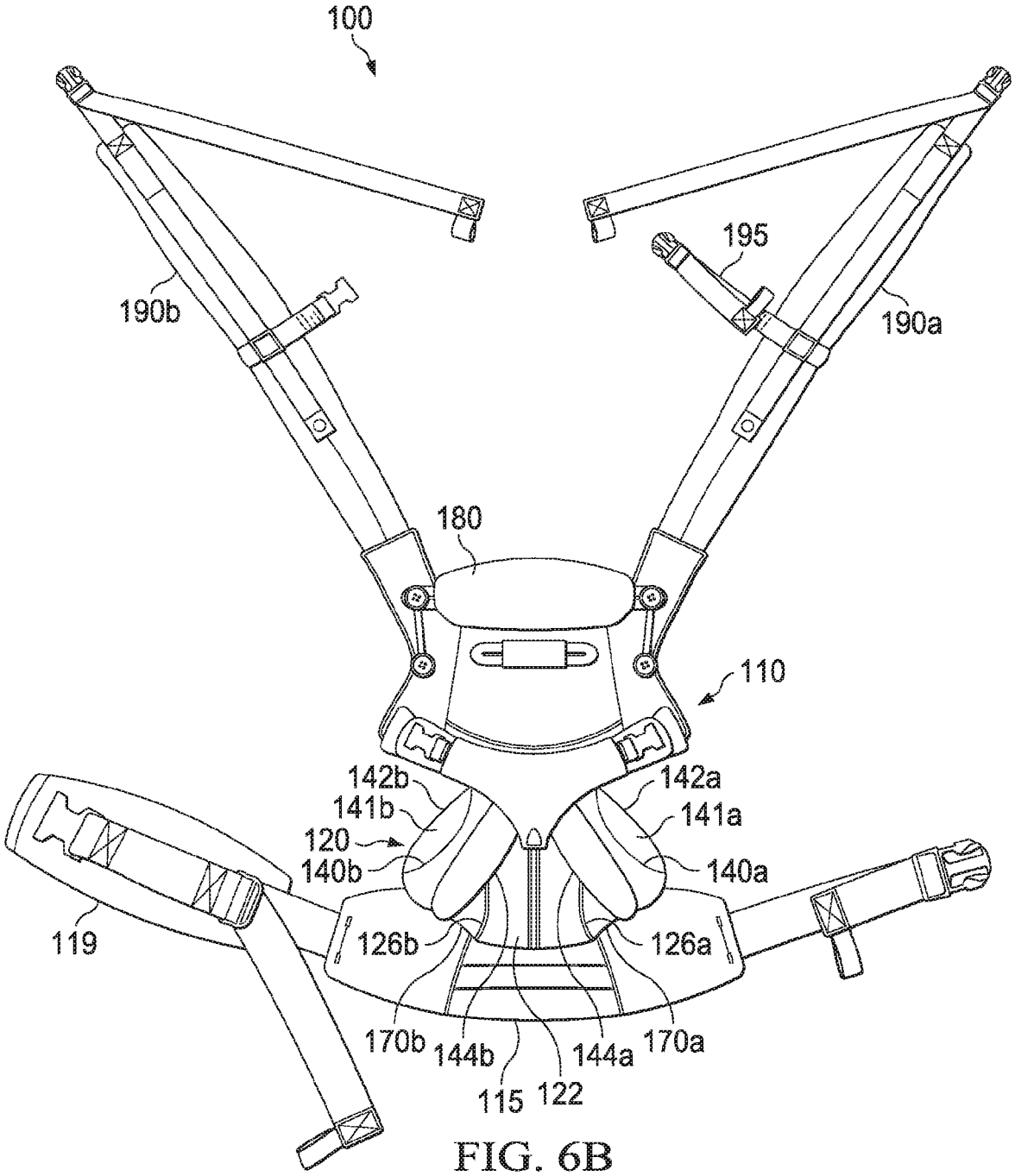
FIG. 6B is a diagrammatic representation of an outside view of one embodiment of adjustable carrier.
Figure 7A:
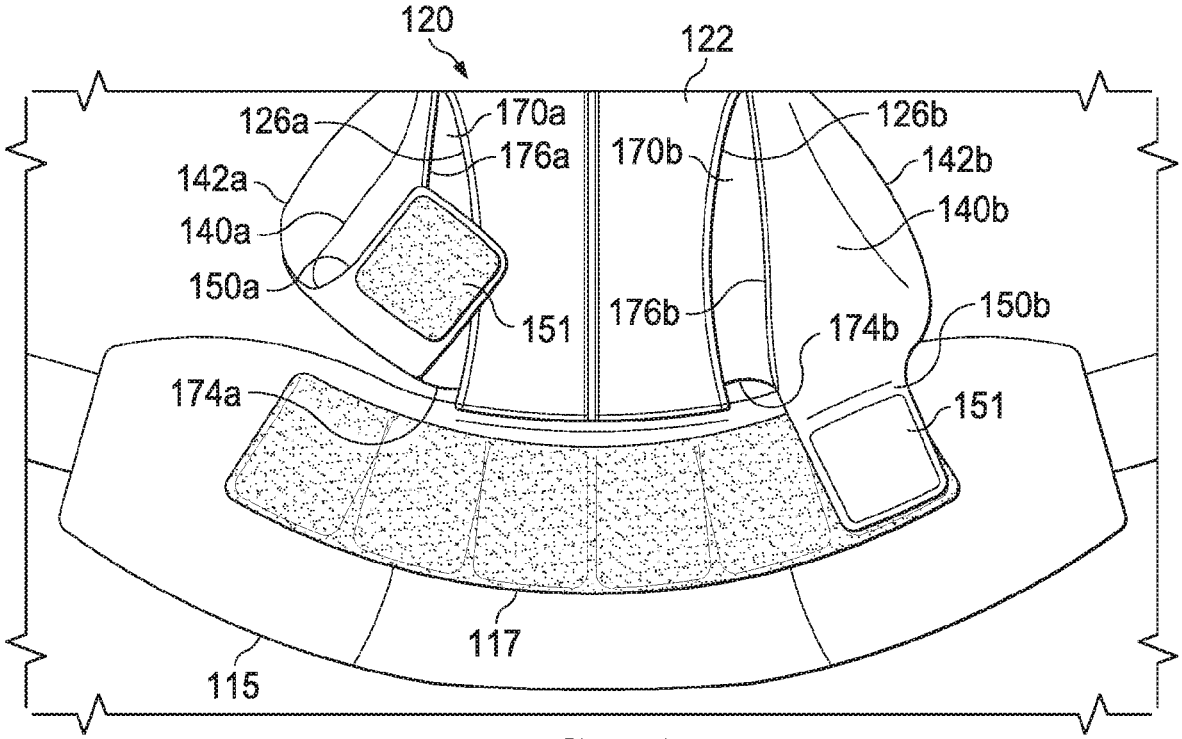
FIG. 7A is a diagrammatic representation of a portion of an adjustable child carrier in a first configuration.
Figure 7B:
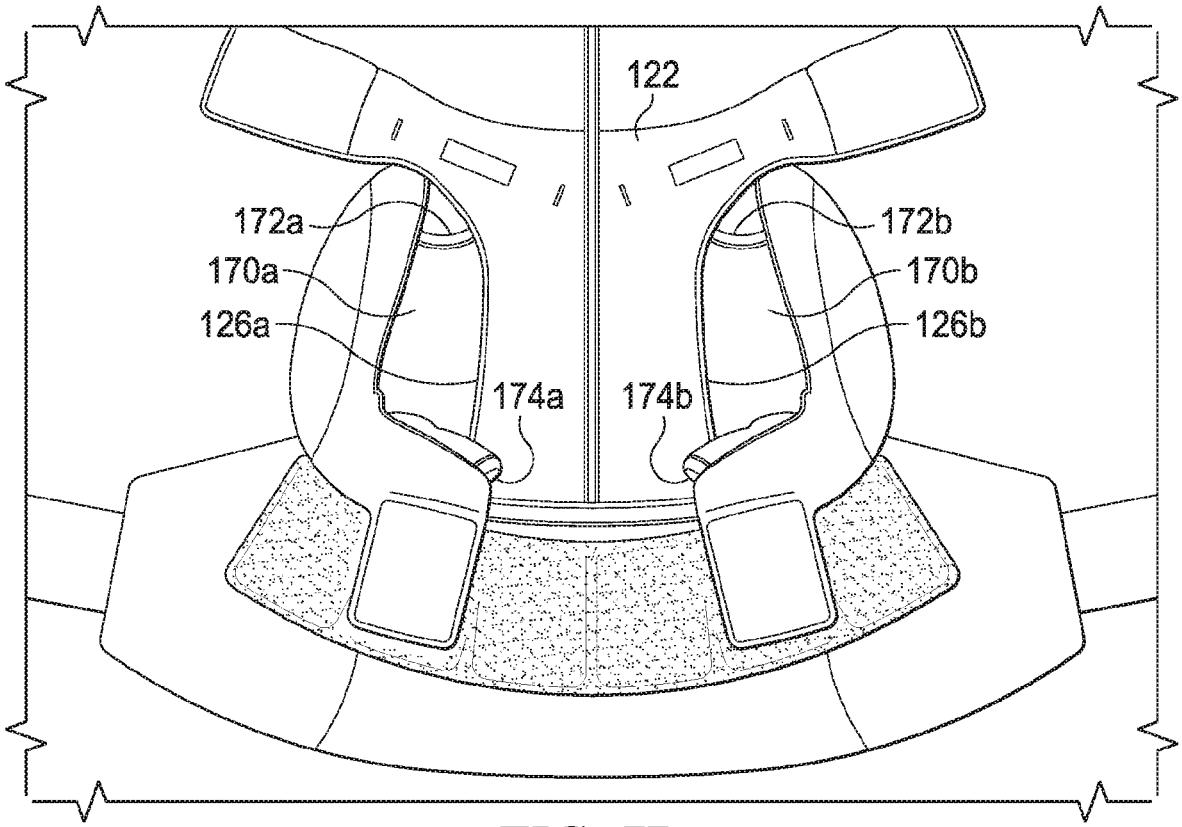
FIG. 7B is a diagrammatic representation of a portion of an adjustable child carrier in a second configuration.
Figure 8A:
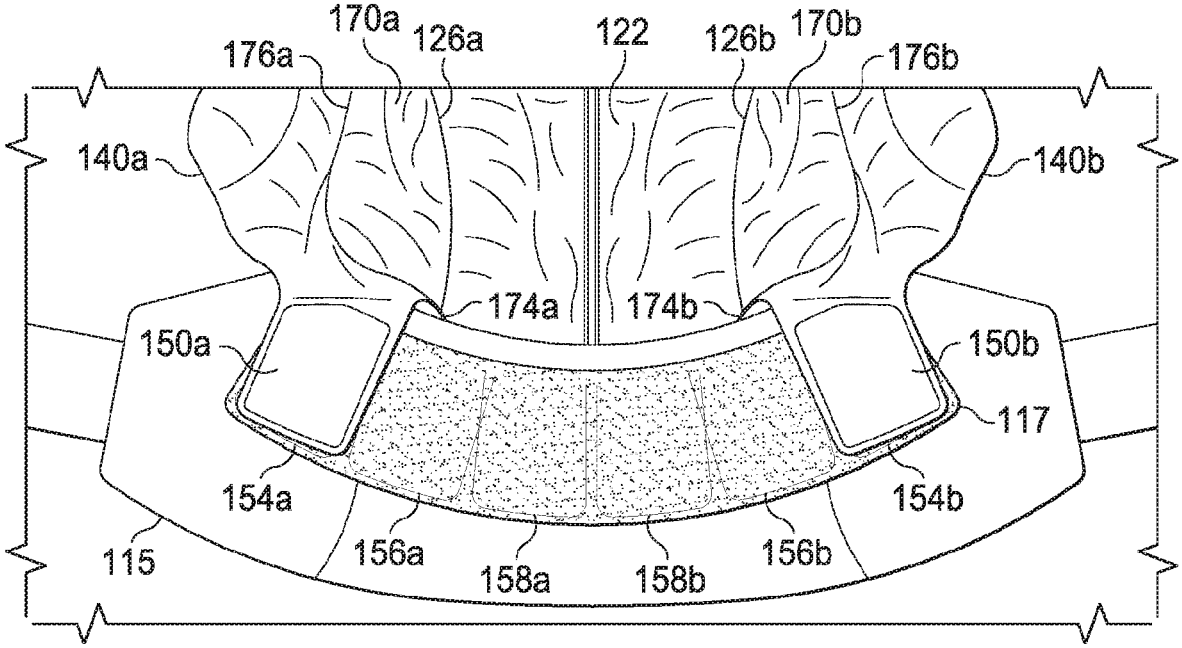
FIG. 8A is a diagrammatic representation of one embodiment of a base width adjustment in a first base width adjustment configuration.
Figure 8B:
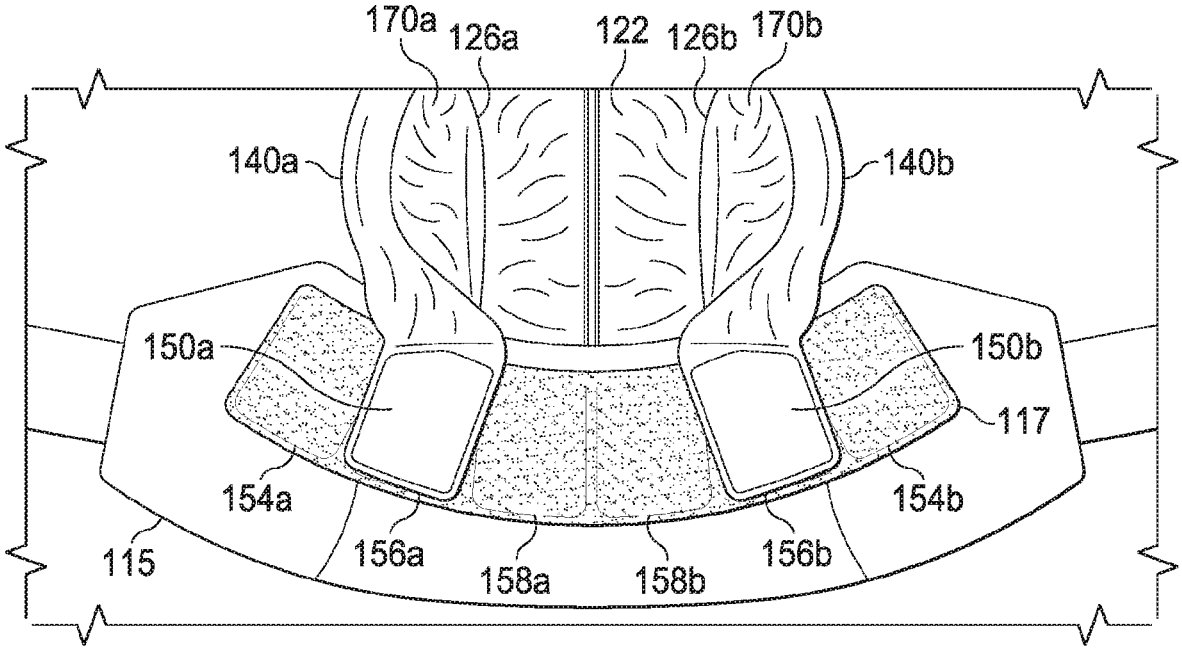
FIG. 8B is a diagrammatic representation of one embodiment of a base width adjustment in a second base width adjuster configuration.
Figure 8C:
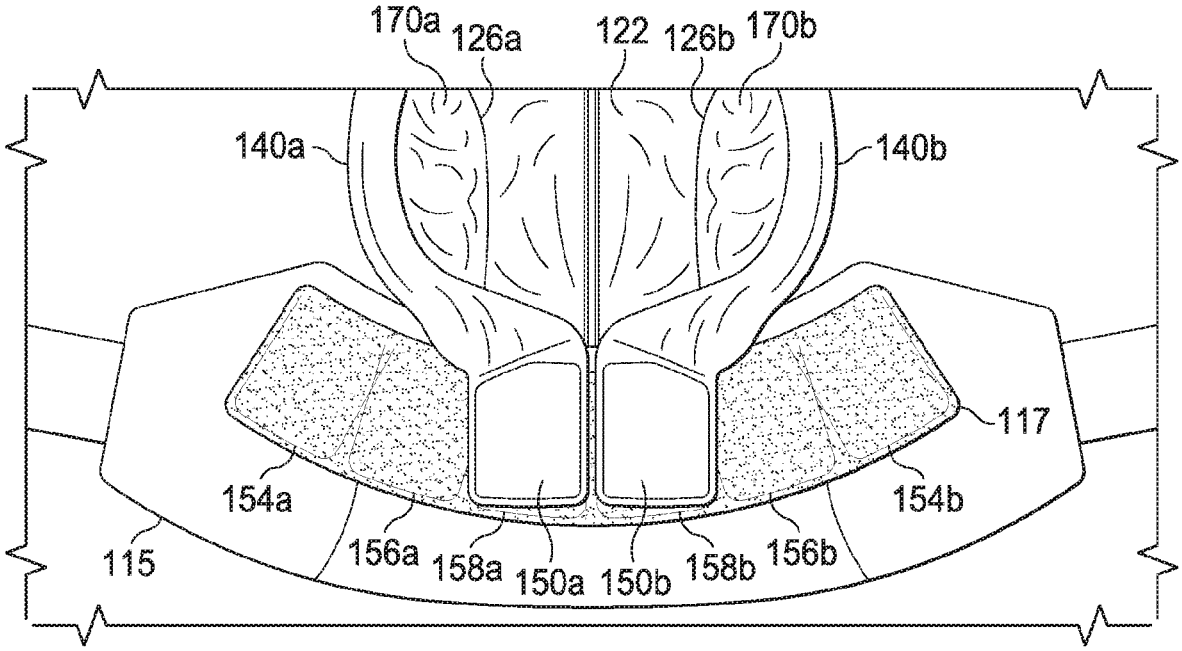
FIG. 8C is a diagrammatic representation of one embodiment of a base width adjustment in a third base width adjustment configuration.
Figure 9A:
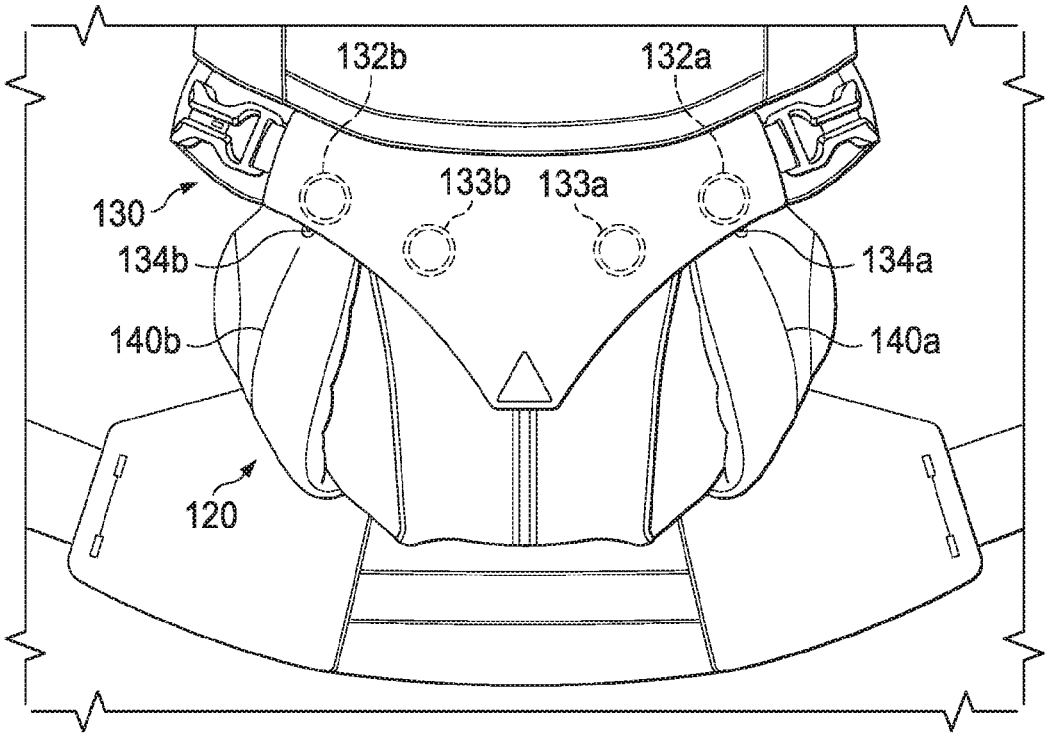
FIG. 9A is a diagrammatic representation of an outside view of a child carrier with a top width adjustment in a first configuration.
Figure 9B:
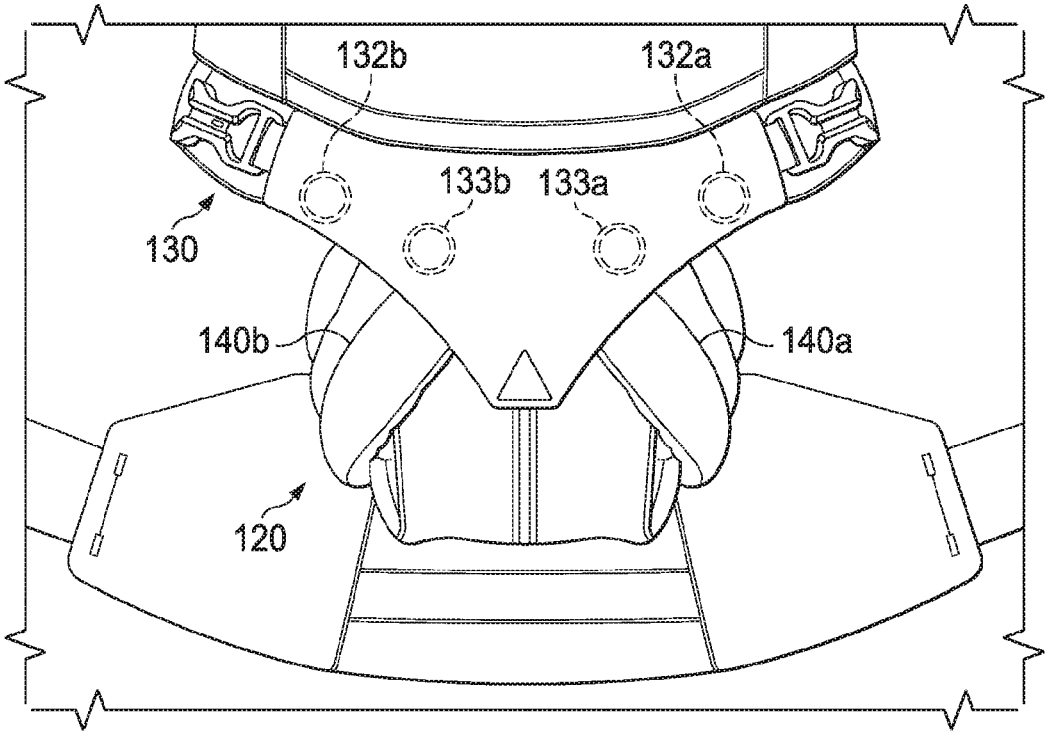
FIG. 9B is a diagrammatic representation of an outside view of a child carrier with a top width adjustment in a second configuration.

FIG. 1 is a diagrammatic representation of one embodiment of an outside view of a multi-position, multi-orientation adjustable carrier 100 worn on a wearer's torso. Adjustable carrier 100 may be worn in a variety of positions and ergonomically support a child in outward and inward facing orientations. FIG. 2 is a side view of one embodiment of an adjustable child carrier 100 worn in a front carry position with a child supported in an outward facing (facing away from the wearer) orientation. That is, the carrier is configured in a "front outward facing" configuration in FIG. 2. FIG. 3 is a side view of one embodiment an adjustable child carrier 100 worn in a front carry position with a child supported in an inward facing (facing toward the wearer) orientation. That is, the carrier is configured in a "front inward facing" configuration in FIG. 3. FIG. 4 is a diagrammatic representation of a side view of one embodiment of an adjustable child carrier 100 worn in a back carry position with a child supported in an inward facing orientation (a "back inward facing" configuration). FIG. 5 is a diagrammatic representation of one embodiment of a child carrier in a side carry (or hip carry) position with a child supported in an inward facing orientation (a "side inward facing" configuration). FIG. 6A and FIG. 6B (collectively "FIG. 6") are, respectively, diagrammatic representations of an inside view (wearer side) and an outside view of an embodiment of adjustable carrier 100. FIG. 7A and FIG. 7B (collectively "FIG. 7") are diagrammatic representations in a portion of one embodiment of a carrier 100 in various configurations. FIG. 8A, FIG. 8B and FIG. 8C (collectively "FIG. 8") are diagrammatic representations one embodiment of a base width adjuster of carrier 100 in a plurality of configurations. FIG. 9A and FIG. 9B (collectively "FIG. 9") are diagrammatic representations of one embodiment of top width adjustment of carrier 100 in a plurality of configurations.

With references to FIG. 6, adjustable carrier 100 comprises a main body 110 coupled to a waist belt 115. Main body 110 includes an upper torso support portion 130, a seat portion 120 and thigh support straps 140 (denoted individually as thigh support straps 140*a*, 140*b*). Carrier 100 may also include shoulder straps 190 (denoted individually as shoulder strap 190*a* and shoulder strap 190*b*) and a chest strap 195. A child can be supported in a child carrying area created by the main body 110 in cooperation with the wearer's torso. Torso support portion 130 is configured to support upper body of the child while in the carrier 100 while seat portion 120 cooperates with adjustable thigh support straps 140 to form an adjustable bucket seat configurable to ergonomically position the child's legs and hips. Waist belt 115 and shoulder straps 190 provide a harness that distributes the child's weight to the wearer. Chest strap 195 can be used to secure left and right shoulder straps together in certain configurations.

In the illustrated embodiment, seat portion 120 comprises a seat center portion 122 that comprise lateral edges 126*a*, 126*b*, a first end portion coupled to waist belt 115 or other portion of carrier 100, a second end portion coupled to torso support portion 130. Laterally outer edges 126*a*, 126*b* of seat center portion 122 may be straight, curved or laterally tapered. Seat center portion 122 may be formed from a single piece of material, or may be formed from multiple pieces of material, multiple layers of materials, or multiple materials. The junction between torso support portion 130 and seat center portion 122 may be a substantially seamless transition. For example, in one embodiment, a center panel may form seat center portion and an upper torso center panel such that seat center portion 122 and the upper torso center panel comprise a unitary construction of one or more layers of material. In other embodiments, the junction may include seams, edges or other features delineating between torso support portion 130 and seat center portion 122.

Thigh support straps 140 can be provided to either side of the seat center portion 122. Each thigh support strap 140*a*, 140*b* can include a respective laterally outer edge 142*a*, 142*b* (e.g., laterally outer edges 142*a*, 142*b*) and laterally inner edge 144*a*, 144*b* that extend from the first end portion to a second end portion of the respective strap 140*a*, 140*b*. The first end portion is more inward (closer to the wearer) than the second end portion when the carrier is worn. The first end portion of each thigh support strap 140*a*, 140*b* can be selectively coupled to waist belt 115 or other structure at multiple positions and the thigh support strap second end portion can be coupled to the torso support portion 130 or other structure at multiple positions.

Seat portion 120 and thigh support straps 140 are adapted to pass from the outer side of the child carrying area (the side away from the wearer's torso) to inner side to form the supportive and adjustable bucket seat. The supportive and adjustable bucket seat can have a generally concave (e.g., "C" shape) inner profile from the inward side to the outward side and from right to left. Seat side edges 142*a*, 142*b* (formed by the edges of thigh support areas 140) can be higher than the center of the seat and can be spaced such that the side edges pass under and around the child's thighs at a distance from the child's hips such that the child's legs (e.g., above the knee) do not dangle down. In some embodiments, thigh support straps 140 may provide additional support. In particular, in certain embodiments the thigh support straps 140 may include gathers, elastic material or another type of biasing material. In one embodiment, thigh support straps 140*a*, 140*b* provide areas of thigh padding 141*a*, 141*b* proximate to the outer edges 142*a*, 142*b* to support the child's thighs.

Child carrier 100 may include one or more adjustment points that work alone or in cooperation to adjust the shape of the bucket seat provided by the child carrier. These adjustment points can be configured to adjust a seat top width, seat base width, seat bucket depth, and seat height. To this end, carrier 100 can include securing mechanisms to releasably secure the first end portions and second end portions of thigh support straps 140 at multiple locations. The securing mechanisms can include any suitable mechanism such as, but not limited to, buttons, snaps, d-rings and clips or hooks, patches of hook and loop material or other securing mechanism. In some embodiments, the securing mechanisms are configured such that the second end (the end further from the wearer) of each thigh support strap is higher than the first end when carrier 100 is worn.

The bucket seat can be adjusted as the child grows to support the child in an ergonomic spread squat position appropriate for the weight or size of the child with the child's pelvis, bottom and thighs all being supported. In an ergonomic spread squat position (also known as the "frog leg", "frog", "squat spread" or "M" position), the flexion at the hip joint is at least 90° and in some cases is 110° to 120° from the coronal plane, and the spreading angle can average at approximately 45-55° from the median plane. As carrier 100 is adjustable, the angle of the hips and spread can depend on the settings of the carrier 100 and developmental stage of the child.

In one embodiment, the carrier can be adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

In accordance with one embodiment, carrier 100 comprises a base width adjustment to selectively couple the first ends of thigh support straps 140*a*, 140*b* to waist belt 115. In the illustrated embodiment, the base width adjuster comprises base width adjusters 150*a*, 150*b* coupled to each thigh support strap 140*a*, 140*b*. Base width adjusters 150*a*, 150*b* may comprise flaps or tabs coupled to the thigh support straps 140 that, in turn, may be releasably secured to waist belt 115. While, in the illustrated embodiment, base width adjusters 150*a*, 150*b* are coupled to a respective thigh support strap 140*a*, 140*b* by virtue of being part of the same thigh support straps, other configurations may also be used. In any event, the base width adjusters 150 can be selectively coupled to waist belt 115 to couple thigh support straps 140 of main body 110 to waist belt 115.

The base width adjustment can be used to adjust the width of the base of main body 110 where it connects to waist belt 115. A fastening mechanism 151 of base width adjusters 150*a*, 150*b*, such as a hook and loop material, buttons, snaps, zipper, etc., can cooperate with a corresponding releasable fastening mechanism 117 on waist belt 115 to couple thigh support areas 140 to waist belt 115. The releasable fastening mechanisms 117, 151 are configured such that the base width adjusters 150*a*, 150*b* may be coupled to the waist belt 115 in multiple positions or throughout a range of positions. Thus, the width of bucket seat proximate to waist belt 115 can be adjusted by changing the position at which base width adjusters 150*a*, 150*b* are secured to waist belt 115. For example, moving the bottom ends of base width adjusters 150*a*, 150*b* laterally inboard (rotating base width adjusters 150*a*, 150*b* inward) decreases the width of main body 110 at the point main body 110 meets waist belt 115 and may serve to decrease the width of the bucket seat where thigh support straps 140*a*, 140*b* pass under the child's thighs. Moving the ends of base width adjusters 150*a*, 150*b* more laterally outboard (rotating base width adjusters 150*a*, 150*b* laterally outward) increases the width of the main body 110 where it is coupled to the waist belt 115 and may increase the bucket seat width where the thigh support straps 140*a*, 140*b* pass under the child's thighs.

The base width adjustment can be used to control the depth of the bucket seat. In a minimum (or narrowest) base width setting the base width adjusters 150 may be fastened to the waist belt 115 such that they are maximally proximate one another toward the center axis of the waist belt 115 (given the range or number of positions possible). In this minimum base width setting, carrier 100 is configured such that the depth of the seat bucket may be at a maximum. In a maximum (or widest) base width setting, the base width adjusters 150 may be fastened to the waist belt 115 such that they are maximally distal one another away from the center axis of the waist belt 115 (given the range or number of positions possible). In this maximum (or widest) base width setting, carrier 100 is configured such that the depth of the bucket seat may be at a minimum.

With further reference to FIG. 7 and FIG. 8, seat portion 120 may include one or more shaping members to facilitate shaping the bucket seat. In one embodiment, bucket seat portion 120 includes gussets 170*a*, 170*b* between gusset inner edges and gusset outer edges that span the gap between the respective inner edges 144*a*, 144*b* of thigh support straps 140*a*, 140*b* and the laterally outer edges 126*a*, 126*b* of seat center portion 122. Gussets 170*a*, 170*b* may have inner edges fastened to seat center portion 122 at or proximate to the laterally outer edge 126*a*, 126*b* or elsewhere and gusset outer edges fastened to respective thigh support straps 140*a*, 140*b* at or proximate to laterally inner edges 144*a*, 144*b* or elsewhere, such as near the center of the respective thigh support straps 140*a*, 140*b*. The gussets 170*a*, 170*b* may have free top edges 172*a*, 172*b* (edges proximate to torso support portion 130) and free edges 174*a*, 174*b* (edges proximate to waist belt 115).

The gussets can act as darts with edges that can be opened and closed to gather or release the gussets. In particular, by adjusting base width adjusters 150*a*, 150*b* and/or the position where the second ends of the thigh support straps 140*a*, 140*b* are fastened to the carrier 100 to decrease the angle or separation between seat center portion 122 and thigh support straps 140*a*, 140*b*, the dart legs can be closed and darts deepened. Consequently, the bucket seat can bulge further and take on a deeper curve. Conversely, adjusting base width adjusters 150*a*, 150*b* and/or the position where the second ends of the thigh support straps 140*a*, 140*b* are fastened to the carrier 100 to increase the angle or separation between seat center portion 122 and thigh support straps 140*a*, 140*b* opens the gussets and makes the shape formed by gusset portions 170*a*, 170*b* shallower. Consequently, the bucket seat formed by carrier 100 will be shallower. Any suitable shaping mechanism can be used to control the fullness of bucket seat including, but not limited to darts, pleats, gathers or tucks.

FIGS. 7-8 illustrate the operation of one embodiment of the base width adjustment. FIG. 7 illustrates carrier 100 stretched out vertically to better illustrate certain features while FIG. 8 illustrates carrier 100 with more depth in the bucket. The base width adjusters 150*a*, 150*b* can be secured to waist belt 115 to either side of the lateral centerline of main body 110 to adjust the width of carrier 100 where thigh support straps 140*a*, 140*b* support the child's thighs. In the embodiment illustrated, hook and loop material is used to releasably secure the base width adjusters 150*a*, 150*b* to waist belt 115 on the side of waist belt 115 sandwiched between waist belt 115 and the wearer. This can increase the hold of the hook and loop material when in use because of the pressure against the base width adjusters 150*a*, 150*b*.

Each base width adjuster 150*a*, 150*b* can be secured to waist belt 115 in multiple positions (several positions are denoted as 154*a*, 154*b*, 156*a*, 156*b*, 158*a*, 158*b*). These positions may correspond to particular size ranges of children. In FIG. 8A, base width adjusters 150*a*, 150*b* are secured at positions 154*a*, 154*b* corresponding to a maximum (or widest) base width setting (see also FIG. 7A). In FIG. 8B, base width adjusters 150*a*, 150*b* are secured at medium base width positions 156*a*, 156*b* (see also FIG. 7B). In FIG. 8C, base width adjusters 150*a*, 150*b* are secured at positions 158*a*, 158*b* corresponding to a minimum (narrowest) base width setting.

Referring to 8A, the base width adjusters 150*a*, 150*b* are secured at positions 158*a*, 158*b* corresponding to a maximum (or widest) base width setting. In this configuration, the laterally inner edges 144*a*, 144*a* of thigh width straps 140*a*, 140*b* are spread away from the respective laterally outer edges 126*a*, 126*b* of center portion 122. In other words, the gussets 170*a*, 170*b* are opened to release the folds between the gusset's laterally outer edges 176*a*, 176*b* and respective gusset laterally inner edges to create less shape (curve) in gussets 170*a*, 170*b*—the gusset laterally inner edges are joined at the laterally outer edges 126*a*, 126*b* of center portion 122 in the illustrated embodiment, but may be located at another location, such as inward of edges 126*a*, 126*b*. By fastening base width adjusters 150*a*, 150*b* to waist belt 115 such that they are maximally distal one another (given the range of possible setting for coupling base width adjusters 150*a*, 150*b* to waist belt 115), tension may be maintained on outer edges of gussets 170*a*, 170*b* such that gusset portions 170*a*, 170*b* remain relatively flat. As such, the bucket seat may be maintained in a relatively flat or less shaped configuration, serving to minimize the depth of the bucket seat.

Referring to FIG. 8C, base width adjusters 150*a*, 150*b* are fastened to the waist belt 115 such that they are maximally proximate one another toward the center axis of the waist belt 115 (given the range or number of positions possible). However, because laterally inner edges 144*a*, 144*b* of thigh support straps 140*a*, 140*b* are drawn close to laterally outer edges 126*a*, 126*b* of seat center support portion 122 (and may overlap center portion 122), gusset portions 170*a*, 170*b* form deeply curved folds. Put another way, by fastening base width adjusters 150*a*, 150*b* to waist belt 115 such that they are maximally proximate one another, the laterally outer edges 176*a*, 176*b* of gusset portions 170*a*, 170*b* may be drawn toward the laterally inner edges of gusset portions 170*a*, 170*b*, creating a corresponding greater curve or dart shape in gusset portions 170*a*, 170*b*. This serves to shape the bucket seat to increase the depth of the bucket seat.

It can be noted that, with the top ends of thigh support straps 140*a*, 140*b* secured, base width adjusters 150*a*, 150*b* as illustrated essentially rotate from a pivot point as they are adjusted. Thus, not only does the lateral position of the attachment position change, but the vertical position does as well (e.g., positions 154*a*, 156*a* and 158*a* for base width adjuster 150*a* are both laterally and vertically displaced from each other and positions 154*b*, 156*b*, 158*b* for base width adjuster 150*b* are both laterally and vertically displaced from each). The use of a rotational motion like this provides a greater change in bucket depth for a given lateral change. Other embodiments, however, could use a more linear motion (e.g., in which the attachment positions are horizontally aligned). Furthermore, positions 154*a*, 154*b*, 156*a*, 156*b*, 158*a*, 158*b* are provided by way of example. In the embodiment illustrated, base width adjusters 150*a*, 150*b* can be coupled to fastening mechanism 117 in a continuous range of positions. Other embodiments may provide discrete attachment points.

Base width adjusters 150*a*, 150*b* primarily adjust the width of the seat proximate to waist belt 115. However, moving away from waist belt 115, the seat (edges 142*a*, 142*b*) may flare out. Thigh width adjusters (not shown) may be provided to adjust the width of the seat away from waist belt 115 and the top width adjustment is provided to adjust the top width of the seat. In particular, thigh width adjusters may be adapted to adjust the width of the bucket seat where edges 142*a*, 142*b* of thigh support straps 140*a*, 140*b* pass under the child's thighs. Thigh width adjusters can be used to pull in thigh support straps 140*a*, 140*b* so that thigh support straps 140*a*, 140*b* do not extend past the child's knee and thus prevent thigh support straps 140*a*, 140*b* from straightening the child's legs or overspreading the child's legs.

According to one embodiment, each thigh width adjuster may be a piece of material(s) (webbing or other material) that is coupled at a first end to the respective thigh support width strap 140 and includes a second end that can be selectively coupled to main body 110 (e.g., to seat center portion 122 or elsewhere). The thigh width adjusters can act as a drawstring system, one on each side, to adjust the width of carrier 100 at thigh level by pulling the thigh support straps 140 laterally inward and thereby further adjusting the width of carrier 100 at the child's thighs. Some embodiments of thigh width adjusters are described in U.S. Provisional Application No. 62/414,564 filed Oct. 28, 2016, entitled "Adjustable Child Carrier with Multiple Carry Orientation," and U.S. patent application Ser. No. 15/337,813 filed Oct. 28, 2016, entitled "Adjustable Child Carrier," issued as U.S. Pat. No. 10,426,275, which are hereby fully incorporated by reference herein in their entireties for all purposes.

Turning to FIG. 9, carrier 100 further includes a top width adjustment providing multiple attachment points for selectively coupling the second end portions of straps 140 to carrier 100. For example, torso portion 130 includes buttons or other releasable securing mechanisms on each side of the lateral centerline of carrier 100 so that each thigh support strap 140 can be selectively secured at multiple locations. The second ends of high support straps 140 may be secured and unsecured as needed when the carrier is worn. The securing mechanisms can include any suitable mechanism such as, but not limited to, buttons, snaps, d-rings and clips or hooks, patches of hook and loop material or other securing mechanism. According to one embodiment, the securing mechanism can comprise a clip that is coupled to a respective thigh support strap 140*a*, 140*b* and that can slide along and be releasably locked at various points along a fabric or plastic rail coupled to torso support portion 130. The securing mechanism may be concealed under a panel or exposed. In the example of FIG. 9, strap 140*a* includes a button hole 134*a* proximate to the second end and can be releasably fastened to upper torso portion via outer button 132*a* or inner button 133*a*. Similarly, strap 140*b* includes a button hole 134*b* proximate to its second end and can be releasably fastened to torso portion 130 via outer button 132*b* or inner button 133*b*.

The top width adjustment is adapted such that the bucket seat is configurable in an inward facing configuration suitable to ergonomically support a child in an inward facing orientation and an outward facing configuration suitable to ergonomically support a child in an outward facing orientation. Securing the second ends of the thigh support straps 140 maximally distal from each other (within the range of selectable positions) may correspond to an inward facing configuration adapted to ergonomically support a child in an inward facing orientation while securing the second ends of thigh support straps 140 maximally proximate to each other (within the range of selectable positions) may correspond to an otherward facing configuration adapted to ergonomically support a child in an outward facing orientation. In FIG. 9, for example, outer buttons 132*a*, 132*b* are positioned to provide an inward facing configuration and inner buttons 133*a*, 133*b* are positioned to provide an outward facing configuration.

The first end portions and second end portions of thigh support straps 140*a*, 140*b* may thus be adjusted such that thigh support straps 140 pass under and around the child's thighs at a distance from the child's hips where the portions of the thigh support straps 140*a*, 140*b* that pass under and around the child's thighs is higher than the child's bottom so that the child's knees are lifted. The thigh support straps 140*a*, 140*b* can have sufficient stiffness such that the child's thighs may be encouraged to spread by the thigh support straps 140*a*, 140*b* or wearer's torso.

As can be understood from the foregoing, the base width adjustment and the top width adjustment may work in cooperation to adjust the carrier 100. In accordance with one embodiment, base width adjusters 150 can be used for adjusting seat depth and provide a gross adjustment for seat width. Thigh width adjusters, if provided, may serve as granular adjustments for width within the range of gross adjustment provided by the base width adjusters 150. Furthermore, the top width adjustment can adjust the angle or separation of the seat edges 142*a*, 142*b*, allowing the shape of the seat to be adjusted. For example, a first seat shape may be more comfortable for a child in an inward facing position while a second seat shape may be more comfortable for the child in an outward facing position.

Carrier 100 may also adjust in height based on other settings of carrier 100. In particular, adjusting base width adjusters 150 adjusts the wearable back height (length from bottom of the bucket seat to top edge 138 of the main body 110). This occurs because the length of the physical carrier material from the top edge 116 of the waist belt 115 at center to the top edge 138 of main body 110 at center remains consistent such that the wearable back height changes depending on the setting of the bucket seat size. A deeper bucket consumes more length of material between edges 116 and 138, thus leaving less measurement for the wearable height. On the other hand, a shallower bucket consumes less length of material between edges 116 and 138, thus leaving more measurement for the wearable height.

Figure 10B:
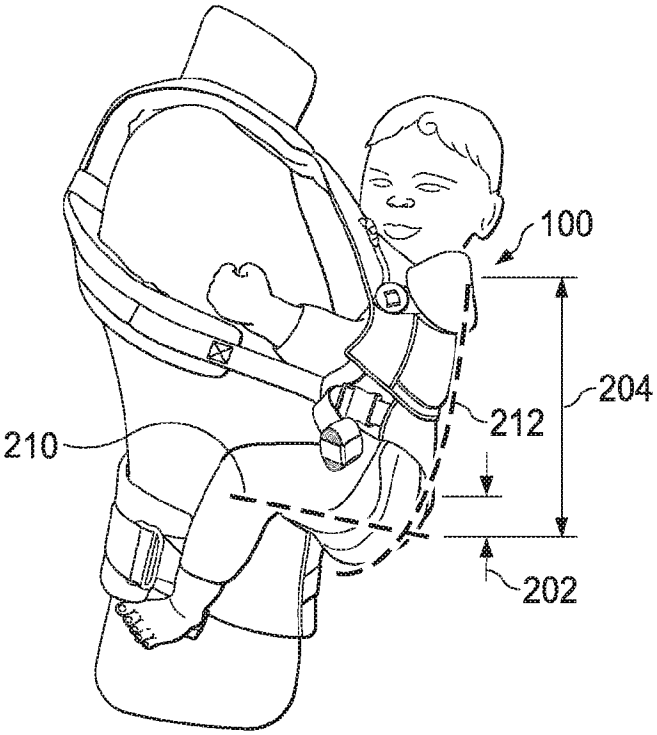
FIG. 10B is a diagrammatic representation of one embodiment of a carrier with a bucket seat in a second seat configuration.
Figure 10A:
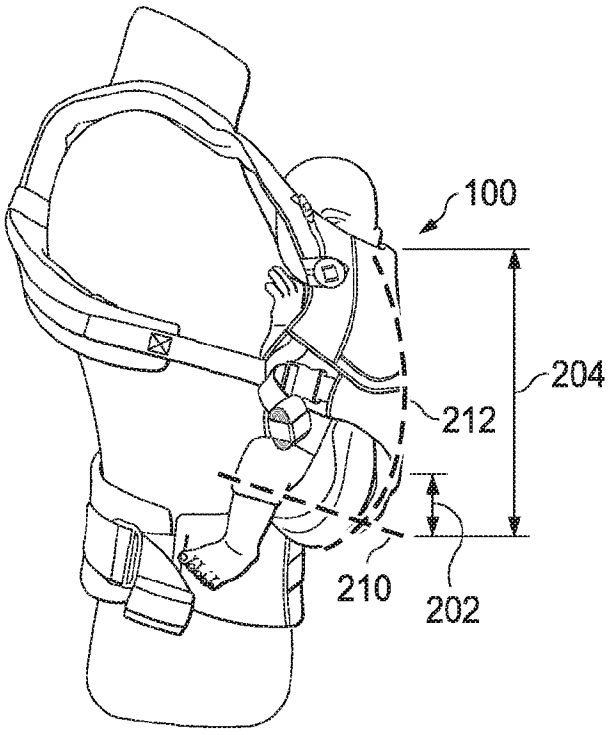
FIG. 10A is a diagrammatic representation of one embodiment of a carrier with a bucket seat in a first seat configuration.
Figure 10C:
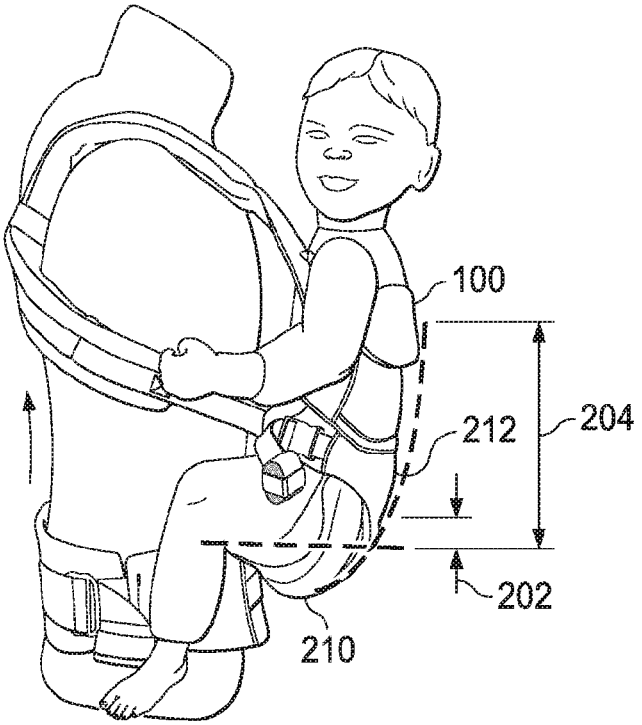
FIG. 10C is a diagrammatic representation of one embodiment of a carrier with a bucket seat in a third seat configuration.

FIGS. 10A, 10B and 10C (collectively FIG. 10) are diagrammatic representations of one embodiment of carrier 100 adjusted to accommodate various sized children. In FIG. 10A-10C, the top width adjustment is set as depicted in FIG. 9A. FIG. 10A corresponds to the minimum base width setting of FIG. 8A, FIG. 10B corresponds to a moderate base width setting of FIG. 8B and FIG. 10C corresponds to the maximum base width setting of FIG. 10C. Through adjusting base width adjusters 150, the width and depth of a seat bucket (indicated by depth 202) can be configured. Furthermore, because the length of material of carrier 100 available to support the back depends on the depth of the seat, adjusting base width adjusters 150 also adjusts the minimum wearable height 204 of carrier 100. As illustrated in FIG. 10, the wearable height 204 of carrier 100 increases with decreasing bucket depth.

With all settings set for a small baby, the seat center portion 122, gusset portions 170 and thigh support straps 140 cooperate to form a deep bucket seat as illustrated in FIG. 10A. The deep bucket seat with higher walls at the thigh (under the knee) tends to lift the child's knees (indicated by line 210) to the appropriate spread squat position and promotes rounding of the back into a c-shape (indicated by line 212). Moreover, a deeper bucket seat shortens the wearable height 204. Thus, the configuration of FIG. 10A may be suitable for infants. As the child grows, the child's spine should naturally straighten, and the child will require less knee support. Base width adjusters 150 can be adjusted to widen the bucket seat and provide additional back support length to support the child's lengthening spine. As shown in FIG. 10B and FIG. 10C, for example, the bucket seat may be adjusted to provide less knee lift, but enough to maintain an appropriate spread squat position (e.g., for an older baby in FIG. 10B and for a toddler in FIG. 10C) and allow the child to rest with a straighter back.

Thus, adjusted to a smallest child mode (e.g., an infant mode) (base width at its smallest/narrowest setting) the bucket seat may be deeper consuming more of the carrier length measurement, thus leaving less measurement for the wearable height (length from the bottom of the bucket seat to the top edge 138 of the torso support portion 130 at center). It should be noted that it may be preferable for the carrier to remain in an inward facing configuration for newborns. Adjusted to a largest child mode (e.g., a toddler mode) (base width at its largest/widest setting) the bucket seat is shallow consuming less of the carrier length measurement, thus leaving more measurement for the wearable height (length from bottom of the bucket seat to the top edge 138 of carrier main body 110 at center). The carrier thus adjustable for the height of the child by adjusting the bucket seat.

Carrier 100 may be adjusted to provide ergonomic support for the child regardless of the size of the child through a supported range. In accordance with one embodiment, carrier 100 can be set for an infant with base width adjusters 150 set at their narrowest settings. In this configuration, the bucket seat will be at its deepest with higher walls at the thigh support straps 140 lifting the child's thighs and knees to a greater angle and into a spread squat position appropriate for that size child. Similarly, carrier 100 can be set for the largest child with the base width adjusters 150 and the thigh width adjusters 160 at their widest settings. In this configuration, the bucket seat may be at its shallowest depth with lower walls at the thigh support areas 140 lifting the child's thighs and knees to a lesser angle and into a spread squat position appropriate for a larger sized child. FIG. 2 illustrates that the seat may also be adjusted to ergonomically support a child's thighs in an outward facing position, for example, with the top width set as illustrated in FIG. 9B.

Thus, the adjustable bucket seat is configurable in a plurality of configurations having different seat bucket depths and seat bucket widths. The different configurations can be adapted to support a child in a corresponding size range in a spread squat position. For example, in one embodiment, bucket seat can have a first configuration adapted to ergonomically carry a child of 20-24 inches (generally corresponding to an infant of 0-3 months and over 7 pounds) in a spread squat position appropriate for the infant without requiring an infant insert. Furthermore, the carrier can have a second configuration adapted to ergonomically carry a child of 24-28 inches (generally corresponding to an older baby of 3-9 months) in a spread squat position appropriate for that child's size. In addition, the carrier, in this example, can have a third configuration adapted to ergonomically carry a child of 28 inches or greater (generally corresponding to an older baby or toddler of 9-48 months (up to the carrying capacity of the carrier or the wearer)). The first configuration can correspond to the base width being at the narrowest setting (deepest bucket seat) (an infant mode), the second configuration can correspond to the base width being at a moderate setting and the third configuration can correspond to the base width being at a widest setting (shallowest bucket seat) (a toddler mode). It can be noted that the ranges provided above are provided by way of example and not limitation.

Furthermore, the seat may have a fourth configuration, such as illustrated in FIG. 2. The fourth configuration has a bucket seat top width that is less than the first configuration, second configuration or third configuration. For example, the first, second and third configurations may have a top width setting that corresponds to FIG. 9A, whereas the configuration of FIG. 2 may have a top width setting that corresponds to FIG. 9B. The base width in a front outward facing configuration may be adjusted based on the size child.

The user can adjust the bucket seat to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The bucket seat can be adjusted to form a sling or pouch that is wider than the child's hips in which the child's bottom is supported. The thigh support straps 140*a*, 140*b* can be adjusted pass under and around the child's thighs at a distance from the child's hips such that the portions of thigh support straps 140*a*, 140*b* that pass under and around the child's thighs are higher than the child's bottom to lift the child's knees. The thigh support straps 140*a*, 140*b* can have sufficient stiffness to encourage the child's thighs to spread by the thigh support straps or wearer's torso.

Returning to FIG. 6, in some configurations, the width of the seat may be less than the width of upper torso support portion 130. In one embodiment, the width of the seat may be narrower than the width of upper torso support portion 130 where the bottom ends of shoulder straps 190 couple to upper torso support portion 130. To this end, the lateral edges of upper torso support portion 130 may taper inward to transition to lateral edges 126*a*, 126*b* of seat center portion 122 forming a horizontal, sloped or curved transition edge portion that can act as the top edge of a side leg opening. When carrier 100 is worn, upper torso support portion 130 may wrap around to the sides of the child, while in some configurations leaving an opening formed by the transition edges 131*a*, 131*b* and seat edges 142*a*, 142*b*.

Carrier 100 may also include an adjustable neck support 1180. Adjustable neck support 180 may be extended to increase the center height of carrier 100, giving additional back or neck support for a child (depending on the size of the child). The neck support 180 may also be folded back away from the wearer to reduce the height of the carrier (e.g., for non-infant children). The neck support 180 may also be folded down toward the wearer such that it may reside inside the child carrying area to give an infant or other child additional head or neck support. The size, shape and position of neck support 180 can be selected so that neck support 180 will fit behind and support the average infant's neck when neck support 180 is folded into the carrier.

Figure 11A:
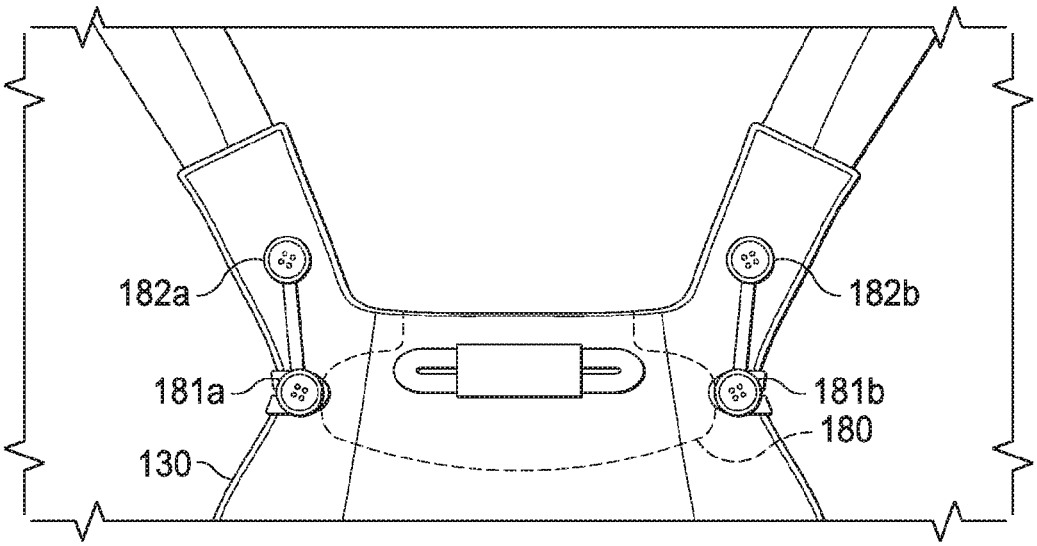
FIG. 11A is a diagrammatic representation of one embodiment of a carrier with a neck support in a first neck support configuration.
Figure 11B:
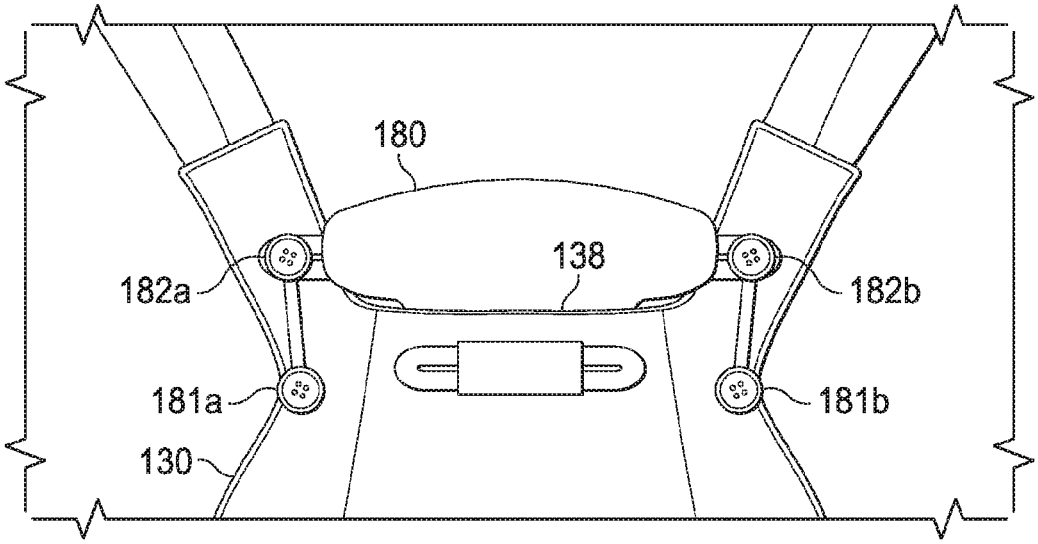
FIG. 11B is a diagrammatic representation of one embodiment of a carrier with a neck support in a second neck support configuration.
Figure 11C:
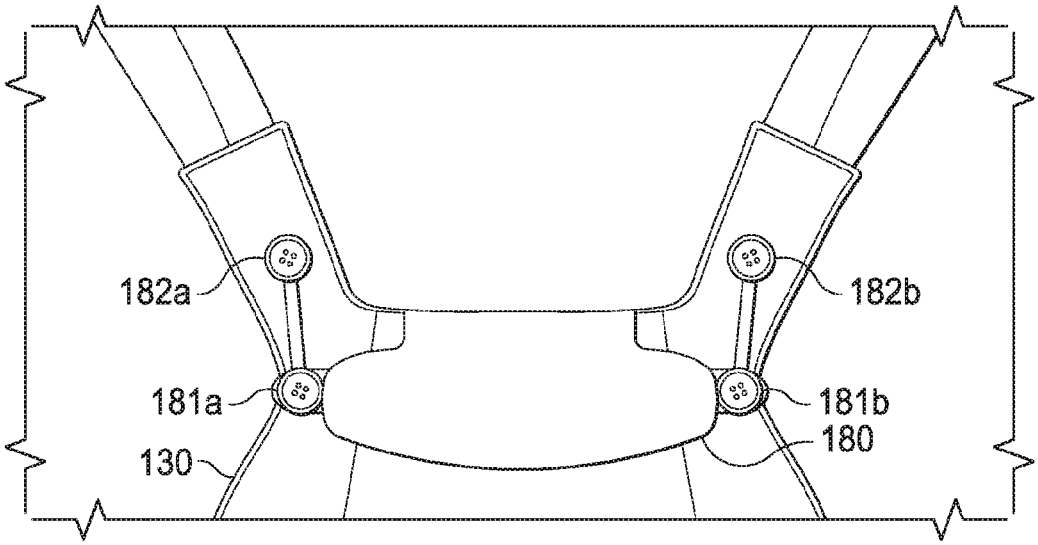
FIG. 11C is a diagrammatic representation of one embodiment of a carrier with a neck support in a third neck support configuration.

FIGS. 11A, 11B and 11C illustrate one embodiment of an outside view of carrier 100 with an adjustable neck support 180 in an inside folded down configuration, an extended configuration and an outside folded down configuration respectively. Carrier 100 includes securing mechanism to releasable secure the neck support 180 in the three positions. For example, carrier 100 includes fasteners 181*a*, 181*b* to secure the neck support 180 in the inside and outside folded down configuration and fasteners 182*a*, 182*b* to releasably secure neck support 180 in the extended configuration.

In the inside folded down position of FIG. 11A, adjustable neck support 180 can be adapted to partially fill the inside of the carrying area of carrier 100 to give infants with insufficient head control more head and neck support (see also FIG. 10A). Adjustable neck support 180 can also be configured in the outside folded down configuration of FIG. 11B to provide additional volume in the carrier as the child grows (see also FIG. 10B). Neck support 180 can be configured in the extended mode (flipped up) as illustrated in FIG. 11C to increase the center back length, giving additional back support for toddlers or head and neck support for non-infant babies. Neck support 180 may be positioned according to the size of the child, or other criteria.

According to one embodiment, adjustable neck support 180 may be joined to main body 110 proximate to top edge 138. The coupling may form a generally horizontal hinge that allows adjustable neck support 180 to flip over edge 138 from the inside folded down configuration to the outside folded down configuration. In the embodiment illustrated, adjustable neck support 180 may be secured in the inside folded down configuration and outside folded down configuration using first set of neck support fasteners 181*a*, 181*b* and may be secured in the extended configuration using a second set of neck support fasteners 182*a*, 182*b* located above the first set of neck support fasteners 181*a*, 181*b*. Preferably, but not necessarily, the neck support fasteners are located on the outside of main body 110.

With reference again to FIG. 6, shoulder straps 190 can be configured to form a loop and attach on either side of the lateral centerline of carrier 100. In other embodiments, shoulder straps may be worn in an "x" configuration. Each shoulder strap 190 may connect to torso support portion 130 at one or more locations to pull torso support portion 130 toward the wearer. A shoulder strap may also couple to main body 110 of carrier 100 above thigh support straps 140 or other portion of carrier 100 on the same side, or an opposite side, of the centerline where the shoulder strap 190 is coupled to the upper torso support portion 130. Shoulder straps 190 may be adjustable and, in some cases, can be re-configured to support multiple carrier positions, such as a front carry, side carry position (hip carry) or back carry position.

Waist belt 115 may have a lumbar support portion 119 and be configured to rest on the wearer's hips. Preferably, the harness is configured so that the child's weight is evenly distributed to the wearer's hips and shoulders and even more preferably such that the child's weight is distributed evenly to the wearer's hips and shoulders and in some cases primarily to the wearer's hips rather than shoulders. In some cases, 70 percent or more of the child's weight can be distributed to the wearer's hips through waist belt 115, thereby promoting wearer comfort and diminishing wearer fatigue.

In accordance with one aspect of the present disclosure, carrier 100 can be a soft structured carrier that incorporates padding, stitching and fabrics to provide structure. Main body 110, including upper torso support portion 130, bucket seat portion 120 and thigh support straps 140 can be flexible and can be formed primarily of natural or synthetic fibers without a rigid frame. As would be understood by a person of ordinary skill in the art, however, some components, such as buckles, fasteners, etc. of a soft structured carrier may be formed of hard plastics, metals and the like.

Carrier 100 may include one or more panels formed from a single piece of material or multiple pieces of material, multiple layers of materials, or multiple materials. For example, in some embodiments, upper torso support portion 130 may be formed with an inner layer selected for comfort against a child's skin and an outer layer selected for breathability, fashion, stain resistance, etc. Upper torso support portion 130 may have straight edges, tapered edges for an area of increased width or decreased width, or otherwise configured for comfort or security of a child or a user. Similarly, bucket seat portion 120 may include one or more panels formed from a single piece of material, or may be formed from multiple pieces of material, multiple layers of materials, or multiple materials. The junction between upper torso support portion 130 and bucket seat portion 120 may be a substantially seamless transition. In one embodiment, the center of upper torso support portion 130 and center of bucket seat portion 120 may be formed from a unitary center panel (of one or more layers) attached to side panels that form the laterally outer portions of upper torso support portion 130 and thigh support straps 140. Inner layers may be selected for comfort against a child's skin and outer layers selected for breathability, fashion, stain resistance, etc. In some embodiments, the center portion may be selected for comfort and lateral portions selected for breathability, security, etc.

Embodiments described herein also allow a child to be carried in an outward facing orientation (i.e., facing away from the person carrying the child) or an inward facing orientation (i.e., facing toward the person carrying the child), and further allow the child to be carried on the front or back or to the side of the person carrying the child. In particular, embodiments described herein provide carriers that support the child's bottom, pelvis and thighs in a desired position in both an outward facing orientation and an inward facing orientation. The carrier can be worn by a user in front of, in back of or to the side the wearer with the child's weight carried near the wearer's center of gravity and close to the wearer's front, back or side in a front, back or side position, respectively.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein and throughout the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the invention.

What is claimed is:

1. An adjustable child carrier for supporting a child by a user, the adjustable child carrier comprising:

one or more adjustable shoulder straps;

a main body configured to support the child against a torso of the user;

a seat portion;

a waist belt;

a first thigh support;

a first thigh support loop configured to receive at least one of one or more thigh support fastener buttons;

a second thigh support, wherein the first thigh support and the second thigh support cooperate with the seat portion to form a bucket seat;

a second thigh support loop configured to receive the at least one of the one or more thigh support fastener buttons, wherein the one or more thigh support fastener buttons are attached to the main body and are configured to couple to the first thigh support loop and the second thigh support loop, wherein the bucket seat is adjusted when the first thigh support loop and the second thigh support loop are coupled to the one or more thigh support fastener buttons;

a first base adjuster coupled to the first thigh support;

a second base adjuster coupled to the second thigh support; and a fastening mechanism disposed on an inner side of the waist belt, wherein selectively attaching the first base adjuster and the second base adjuster along the fastening mechanism adjusts a base width of the bucket seat.

2. The adjustable child carrier of claim 1, wherein the one or more thigh support fastener buttons are configured to adjust at least a top width of the bucket seat.

3. The adjustable child carrier of claim 2, wherein the one or more thigh support fastener buttons comprises a first thigh support fastener button and a second thigh support fastener button, wherein, when the first thigh support loop is attached to the first thigh support fastener button and the second thigh support loop is attached to the second thigh support fastener button, the top width of the bucket seat is reduced.

4. The adjustable child carrier of claim 3, wherein, when the top width of the bucket seat is reduced, the adjustable child carrier is configured to support the child in an outward facing position, wherein, when the top width of the bucket seat is not reduced, the adjustable child carrier is configured to support the child in an inward facing position.

5. The adjustable child carrier of claim 1, further comprising:

an adjustable neck support configured to support a neck or a head of the child; and one or more neck support fasteners for securing the adjustable neck support in a supporting position.

6. The adjustable child carrier of claim 5, wherein the one or more neck support fasteners are disposed on the one or more adjustable shoulder straps for providing the adjustable neck support in an upward position, and wherein the one or more neck support fasteners secure the adjustable neck support in the upward position when the child is positioned to face the user.

7. The adjustable child carrier of claim 6, wherein the one or more neck support fasteners is a first neck support fastener; and further comprising a second neck support fastener disposed on the main body for securing the adjustable neck support in a downward position, wherein the second neck support fastener secures the adjustable neck support in the downward position when the child is positioned to face away from the user.

8. The adjustable child carrier of claim 1, wherein the one or more adjustable shoulder straps comprise a first adjustable shoulder strap and a second adjustable shoulder strap; and further comprising a chest strap coupled to the first adjustable shoulder strap and the second adjustable shoulder strap, wherein the chest strap is adjustable along a first length of the first adjustable shoulder strap and a second length of the second adjustable shoulder strap.

9. The adjustable child carrier of claim 1, further comprising:

a first thigh support padding provided on the first thigh support; and a second thigh support padding provided on the second thigh support.

10. An adjustable child carrier for supporting a child by a user, the adjustable child carrier comprising:

an adjustable waist belt configured to wrap a torso of the user;

one or more adjustable shoulder straps;

a main body configured to support the child against the torso of the user;

a seat portion;

a first thigh support;

a first thigh support attachment coupled to a first end of the first thigh support;

a second thigh support, wherein the first thigh support and the second thigh support cooperate with the seat portion to form a bucket seat;

a second thigh support attachment coupled to a first end of the second thigh support;

one or more thigh support fasteners, wherein the one or more thigh support fasteners are attached to the main body and are configured to couple to the first thigh support attachment and the second thigh support attachment, wherein the bucket seat is adjusted when the first thigh support attachment and the second thigh support attachment are coupled to the one or more thigh support fasteners; and a first base adjuster coupled to a second end of the first thigh support;

a second base adjuster coupled to a second end of the second thigh support; and a fastening mechanism disposed on an inner side of the adjustable waist belt, wherein attaching the first base adjuster and the second base adjuster to the fastening mechanism couples the first thigh support and the second thigh support to the adjustable waist belt, wherein adjusting the first base adjuster and the second base adjuster along the fastening mechanism adjusts a base width of the bucket seat.

11. The adjustable child carrier of claim 10, further comprising an upper torso support portion, wherein the upper torso support portion and the seat portion comprises a breathable outer layer.

12. The adjustable child carrier of claim 10, wherein the one or more adjustable shoulder straps comprise a first adjustable shoulder strap and a second adjustable shoulder strap; and further comprising a chest strap coupled to the first adjustable shoulder strap and the second adjustable shoulder strap, wherein the chest strap is adjustable along a first length of the first adjustable shoulder strap and a second length of the second adjustable shoulder strap.

13. The adjustable child carrier of claim 10, wherein attaching the first thigh support and the second thigh support to an innermost position on the fastening mechanism minimizes the base width of the bucket seat.

14. The adjustable child carrier of claim 10, wherein the one or more thigh support fasteners are configured to adjust the first thigh support and the second thigh support to adjust a top width of the bucket seat.

15. The adjustable child carrier of claim 14, wherein the one or more thigh support fasteners comprises a first thigh support fastener and a second thigh support fastener, wherein, when the first thigh support attachment is attached to the first thigh support fastener and the second thigh support attachment is attached to the second thigh support fastener, the adjustable child carrier is configured to support the child in an outward facing position.

16. An adjustable child carrier for supporting a child by a user, the adjustable child carrier comprising:

one or more adjustable shoulder straps;

a main body configured to support the child against a torso of the user;

a waist belt;

a first thigh support;

a second thigh support;

a seat portion, wherein the first thigh support and the second thigh support cooperate with the seat portion to form a bucket seat, a first thigh support fastener;

a second thigh support fastener;

wherein the first thigh support fastener and the second thigh support fastener are attached to the main body and are configured to couple to the first thigh support and the second thigh support, wherein attaching the first thigh support to the first thigh support fastener and attaching the second thigh support to the second thigh support fastener reduces a top width of the bucket seat, wherein, when the top width of the bucket seat is reduced, the adjustable child carrier is configured to support the child in an outward facing position;

a first base adjuster coupled to the first thigh support;

a second base adjuster coupled to the second thigh support;

a fastening mechanism disposed on an inner side of the waist belt, wherein selectively attaching the first base adjuster and the second base adjuster along the fastening mechanism adjusts a base width of the bucket seat;

an adjustable neck support configured to support a neck or a head of the child;

a first set of neck support fasteners for securing the adjustable neck support in a supporting position, wherein the first set of neck support fasteners are disposed on the one or more adjustable shoulder straps for providing the adjustable neck support in an upward position, wherein the first set of neck support fasteners secure the adjustable neck support in the upward position when the child is positioned in an inward facing position; and a second set of neck support fasteners disposed on the main body for securing the adjustable neck support in a downward position, wherein the second set of neck support fasteners secures the adjustable neck support in the downward position when the child is positioned in the outward facing position.

17. The adjustable child carrier of claim 16, wherein the first thigh support and the second thigh support are configured to support thighs of the child to support the child in an ergonomic spread squat position such that a flexion at a hip joint of the child is at least 90 degrees.

18. The adjustable child carrier of claim 16, wherein the first thigh support fastener is a first button, wherein the second thigh support fastener is a second button, and further comprising a first thigh support loop and a second thigh support loop, wherein the first thigh support is configured to attach to the first button by the first thigh support loop, and the second thigh support is configured to attach to the second button by the second thigh support loop.

19. The adjustable child carrier of claim 16, wherein the one or more adjustable shoulder straps comprise a first adjustable shoulder strap and a second adjustable shoulder strap; and further comprising a chest strap coupled to the first adjustable shoulder strap and the second adjustable shoulder strap, wherein the chest strap is adjustable along a first length of the first adjustable shoulder strap and a second length of the second adjustable shoulder strap.

20. The adjustable child carrier of claim 19, wherein the first adjustable shoulder strap attaches to the main body below a first arm of the child and the second adjustable shoulder strap attaches to the main body below a second arm of the child when the child is in the bucket seat.

* * * * *